US011421383B2

(12) United States Patent
Hart et al.

(10) Patent No.: US 11,421,383 B2
(45) Date of Patent: Aug. 23, 2022

(54) STEAM BOX WITH MULTIPLE VALVES AND DIFFUSER PLATES AND RELATED SYSTEM

(71) Applicant: Andritz Inc., Alpharetta, GA (US)

(72) Inventors: Nicholas Hart, Decatur, GA (US); Lairton Cardoso, Tucker, GA (US); Peter Ebneth, Maintal (DE); Andries Nienaber, Tucker, GA (US)

(73) Assignee: ANDRITZ INC., Alpharetta, GA (US)

( * ) Notice: Subject to any disclaimer, the term of this patent is extended or adjusted under 35 U.S.C. 154(b) by 0 days.

(21) Appl. No.: 16/999,777

(22) Filed: Aug. 21, 2020

(65) Prior Publication Data

US 2021/0062425 A1 Mar. 4, 2021

Related U.S. Application Data

(60) Provisional application No. 62/892,184, filed on Aug. 27, 2019.

(51) Int. Cl.
*D21F 7/00* (2006.01)

(52) U.S. Cl.
CPC ..... *D21F 7/00* (2013.01); *D21F 7/003* (2013.01)

(58) Field of Classification Search
CPC ..... D21F 7/008; D21F 7/003; D21F 7/00; D21G 9/0009; D21G 7/00; D21G 1/0093; D21G 9/00
See application file for complete search history.

(56) References Cited

U.S. PATENT DOCUMENTS 4,358,900 A * 11/1982 Dove ..... D21F 7/008 162/207
4,836,894 A 6/1989 Chance et al.
(Continued)

FOREIGN PATENT DOCUMENTS

EP 1081278 A2 7/2001
EP 1310591 B1 7/2007
(Continued)

OTHER PUBLICATIONS

European Application No. 20192884.3, Extended European Search Report dated Dec. 4, 2020, 10 pages.

*Primary Examiner* — Eric Hug
*Assistant Examiner* — Matthew M Eslami
(74) *Attorney, Agent, or Firm* — Kilpatrick Townsend & Stockton LLP

(57) ABSTRACT

The problem of inconsistent steam penetration of a fibrous sheet is solved by a steam box having a steam header, a diffuser housing disposed within the steam header, wherein walls disposed in the diffuser housing divide an inside of the diffuser housing into multiple diffuser chambers, wherein a valve is configured to fluidly and programmatically communicate with each of the multiple diffuser chambers, such that a steam from the header box may selectively enter one of the diffuser chambers depending upon the valve's orientation in an open or closed position; and multiple orifices of different sizes per diffuser chamber. Ideally, exemplary steam boxes may also comprise a diffuser plates per diffuser chamber. Preferably, the diffuser plates may be located at a bottom of the diffuser chamber. Exemplary steam box systems may further comprise control equipment to manage the flow of steam from the steam header into the diffuser chambers.

17 Claims, 9 Drawing Sheets

(56) References Cited

U.S. PATENT DOCUMENTS

| | | | | |
|---|---|---|---|---|
| 5,077,913 | A | 1/1992 | Akerblom et al. | |
| 5,711,087 | A | 1/1998 | Pazdera | |
| 7,429,311 | B2 * | 9/2008 | Pietikainen ..... | D21G 7/00<br>118/325 |
| 2005/0283995 | A1 | 12/2005 | Hamel | |

FOREIGN PATENT DOCUMENTS

| | | | |
|---|---|---|---|
| EP | 1636419 | B1 | 4/2017 |
| WO | WO 99/41450 | A1 | 8/1999 |
| WO | WO2013/116397 | A1 | 8/2013 |

* cited by examiner

STEAM BOX WITH MULTIPLE VALVES AND DIFFUSER PLATES AND RELATED SYSTEM

CROSS-RELATED APPLICATION

This application claims the benefit under 35 U.S.C. § 119(e) of the earlier filing date of U.S. Provisional Patent Application No. 62/892,184 filed on Aug. 27, 2019, the entire contents of which is incorporated herein by reference.

BACKGROUND OF THE INVENTION

Technical Field

The present disclosure relates generally to paper-making machines and more particularly to apparatuses, systems, and methods for utilizing a type of steam distributor called a "steam box."

Related Art

Modern papermaking machines share many of the design principles of the Fourdrinier-type papermaking machine. To describe paper production with a modern papermaking machine briefly, the process starts with operators pumping a slurry of highly diluted wood pulp and water into a holding tank commonly known as a "headbox." The headbox then ejects the slurry at high velocity onto a wire mesh to form a nascent paper web. A downstream press section then dewaters much of the web and a subsequent dryer section further reduces the web's remaining moisture. After the drying section, the paper sheet may pass through a size press section for chemical or material treatments to improve the paper's physical and chemical properties. The dried paper sheet then passes through a calendaring section for finishing before winding in a reel section for collection.

Several web properties contribute to the quality and grade of the final product. Two of the most significant properties are the web's moisture profile and the web's temperature profile. Moisture profile variation occurs naturally throughout the production process. The two main culprits are: the fibers themselves and equipment variability. For example, the non-uniform nature of how the paper mat is formed can cause uneven drainage across the width of the paper machine, thereby allowing for some spots to be drier than others. Equipment on the machine can also have slight variations in the CD that would cause the paper mat to drain differently. For example, the forming section of a paper machine contains boxes with angular ceramic foil blades. If these blades are not uniform across the CD, they will cause drainage at different rates. Dryer cans (i.e. large steam heated steel drums) can have fiber build up on them that can cause the paper to dry unevenly as well. In extreme cases, if a sheet becomes too dry, the sheet can crack and break, which results in machine downtime and production loss.

Variations in the web's cross-machine direction ("CD") moisture profile for example, can lead to paper mills applying more fiber to dryer areas of the web. This can lead to web thickness variations. If these variations are not equalized, the final paper product will have thickness variations that will degrade the paper's quality and cost the mills more to produce. Furthermore, thickness variations can contribute to the uneven application of coating to a paper, which can result in uneven printing. Temperature profile variations can cause uneven drying of the paper, which can result in curling issues, which in turn can make the paper unsellable.

Steam boxes are commonly used in the press and fourdrinier sections when the web is traveling over a vacuum source to mitigate moisture and temperature profile variation and to facilitate dewatering generally. Steam boxes can also be used in the drying and calendaring sections to relax the paper fibers to improve smoothness or gloss. As the name suggests, the steam box is a steam receptacle and distributor. Piping and valves typically introduce steam into the steam box, and the steam box in turn expels the collected steam onto a fast-moving paper web disposed adjacent to steam exhaust holes. A thin layer of air is disposed between the exhaust side of the steam box and the moving web.

When the steam box introduces steam into the web, the steam raises the temperature of the water disposed inside of the web, thereby lowering the water's viscosity. When used correctly, the entrapped water's lowered viscosity allows the vacuum to remove the water faster and more easily. Stated simply, the more steam a section of the web receives, the dryer that section becomes.

Many current steam boxes have steam valves configured to introduce steam into a single internal steam diffuser chamber. The steam collects in the single diffuser chamber and then diffuses though exhaust holes in a plate disposed at the bottom of the diffuser chamber. The steam box disclosed in U.S. patent application Ser. No. 11/122,131 provides an example of this arrangement. These steam boxes are designed to have steam exit these exhaust holes consistently at 100% of the design-rated exit flow capacity. For example, if the steam box was rated to introduce steam into the web at a rate of 200 kilo per ton of paper produced, ideal production assumptions can only be met if the steam is exiting the steam box at full capacity (i.e. at a rate of 200 kg per ton of paper produced).

However, dynamic operating conditions and web's variable CD moisture profile may encourage the operator to reduce the steam's exit rate periodically. This rate can be expressed as a percentage of the steam box's total exit rate capacity. The design disclosed in U.S. patent application Ser. No. 11/122,131 permits the operator to partially close the steam valves that introduce steam into the diffuser chamber to reduce the exit rate of the steam. This practice not only reduces the steam's exit capacity, but also reduces the distance the steam travels over time (or stated inversely, this practice increases the time required for the steam to travel the same distance). For example, an operator may choose to close the steam input valve by 30% with the goal of reducing the rate of steam being introduced into the web, however, the actual rate of steam exiting the exhaust holes is unlikely to be 30%.

Furthermore, the reduced steam exit speed, which is tied to the steam's reduced exit capacity in conventional designs, can result in several problems. For example, the design disclosed in U.S. patent application Ser. No. 11/122,131 does not give the operator reliable control over the steam's impulse (i.e. the force the steam exerts on its surroundings). If the speed, and therefore the impulse of the steam exiting the steam box is too low, the steam will not penetrate the layer of air disposed between the exhaust side of the steam box and the fast-moving web. When this happens, the steam box is not effectively drying the web. Lower steam exit speeds also allow the steam to diffuse more before reaching the web. As a result, an operator's ability to target a desired section of the web degrades as steam exit speed decreases.

Conversely, if the impulse of the steam is too high, the steam will destroy the surface of the web, and render this surface unsuitable for receiving coatings downstream, which can eventually render the paper unsuitable for printing. If the steam impulse is too great, the steam can also accumulate in areas of higher pressure over the web, thereby re-directing incoming steam to untargeted areas of the web, and causing some of the steam to flow back toward the exhaust side of the steam box without interacting with the web. This steam blowback increases energy consumption and waste.

SUMMARY OF THE INVENTION

The problem of inconsistent steam penetration of a fibrous sheet is solved by a steam box having a steam header, a diffuser housing disposed within the steam header, wherein walls disposed in the diffuser housing divide an inside of the diffuser housing into multiple diffuser chambers, wherein a valve is configured to fluidly and programmatically communicate with each of the multiple diffuser chambers, such that a steam from the header box may selectively enter one of the diffuser chambers depending upon the valve's orientation in an open or closed position; and multiple orifices of different sizes per diffuser chamber. Ideally, exemplary steam boxes may also comprise a diffuser plates per diffuser chamber. Preferably, the diffuser plates may be located at a bottom of the diffuser chamber. Exemplary steam box systems may further comprise control equipment to manage the flow of steam from the steam header into the diffuser chambers.

Without being bound by theory, it is believed that a steam box in accordance with the present disclosure will provide a constant exit steam speed instead of a varying steam speed with valve position, which is what currently happens with conventional designs. It is envisioned that steam exiting a steam box in accordance with the present disclosure can constantly penetrate the web at a desirably constant speed and thereby give proper zone definition without steam spilling into other zones. Steam spilling into other zones can cause poor moisture control.

Moisture profile on a paper machine is generally controlled by the scanner near the reel. Control programs are set up so that one zone of the steam box matches up to a multiple of scanner measurement zones. This is because scanners normally measure the moisture profile at a high resolution. If steam box zones begin to spill into each other, the moisture profile control program will not be able to work effectively as CD zone 2 may cause excess dryness in CD zones 1 and 3.

In certain exemplary embodiments, a steam box may comprise: a steam box housing; multiple valves per diffusion zone; multiple orifices of different sizes per diffusion zone; a removable diffuser plate per at least one diffusion zone; a steam header disposed within the steam box housing; and control equipment.

The steam box housing may preferably be made from stainless steel. In certain exemplary embodiments, the control equipment may comprise a programmable logic controller ("PLC") or a distributed control system ("DCS").

Without being bound by theory, it is believed that the steam box housing gives the steam box strength and stability as well as a place for the steam to gather. The steam header distributes steam into the steam box. The valves control the flow of steam. The orifice ensures that the steam exists the diffusion zone at the desired rate. The diffuser plates introduce the steam to the paper at the desired rate. The control equipment provides interface between the system and the environment.

Other exemplary embodiments may further comprise a feedback system for steam exiting the diffuser plates. It is contemplated that steam boxes as described herein may be used on the wet end of the paper machine (i.e. the section of the machine where pulp exits the headbox to be formed into sheets of paper on forming fabrics) and the dry end of the paper machine to relax fibers through the application of heat and moisture to improve smoothness or gloss.

It is contemplated that the pressure in the steam box should not exceed 15 pounds per square inch ("psi"). It is further contemplated that the temperature should not exceed: 150 degrees Celsius ("° C.") or about 300 degrees Fahrenheit ("° F.").

It is further contemplated that steam box assemblies and systems in accordance with the present disclosure can minimize the amount of steam held in reserve in the diffuser chambers over conventional designs. Therefore, steam box assemblies in accordance with the present disclosure may be smaller than conventional steam boxes, thereby allowing more placement versatility on the paper machine.

BRIEF DESCRIPTION OF THE DRAWINGS

The foregoing will be apparent from the following more description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

Figure 1:
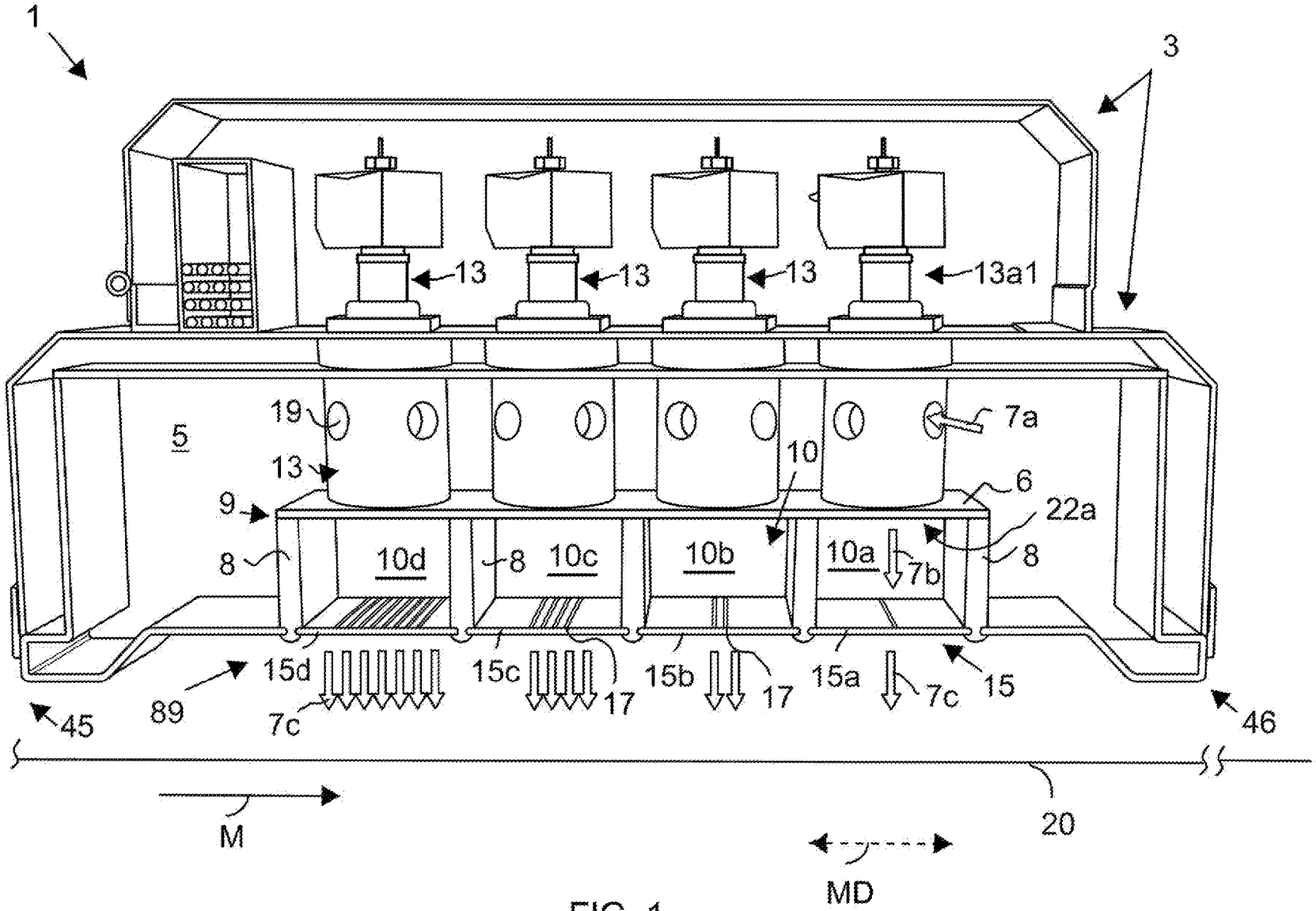
FIG. 1 is a cross-sectional view of an exemplary steam box having multiple diffuser chambers.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a feature, structure, or characteristic, but every embodiment may not necessarily include the feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "inlet' and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

Figure 8:
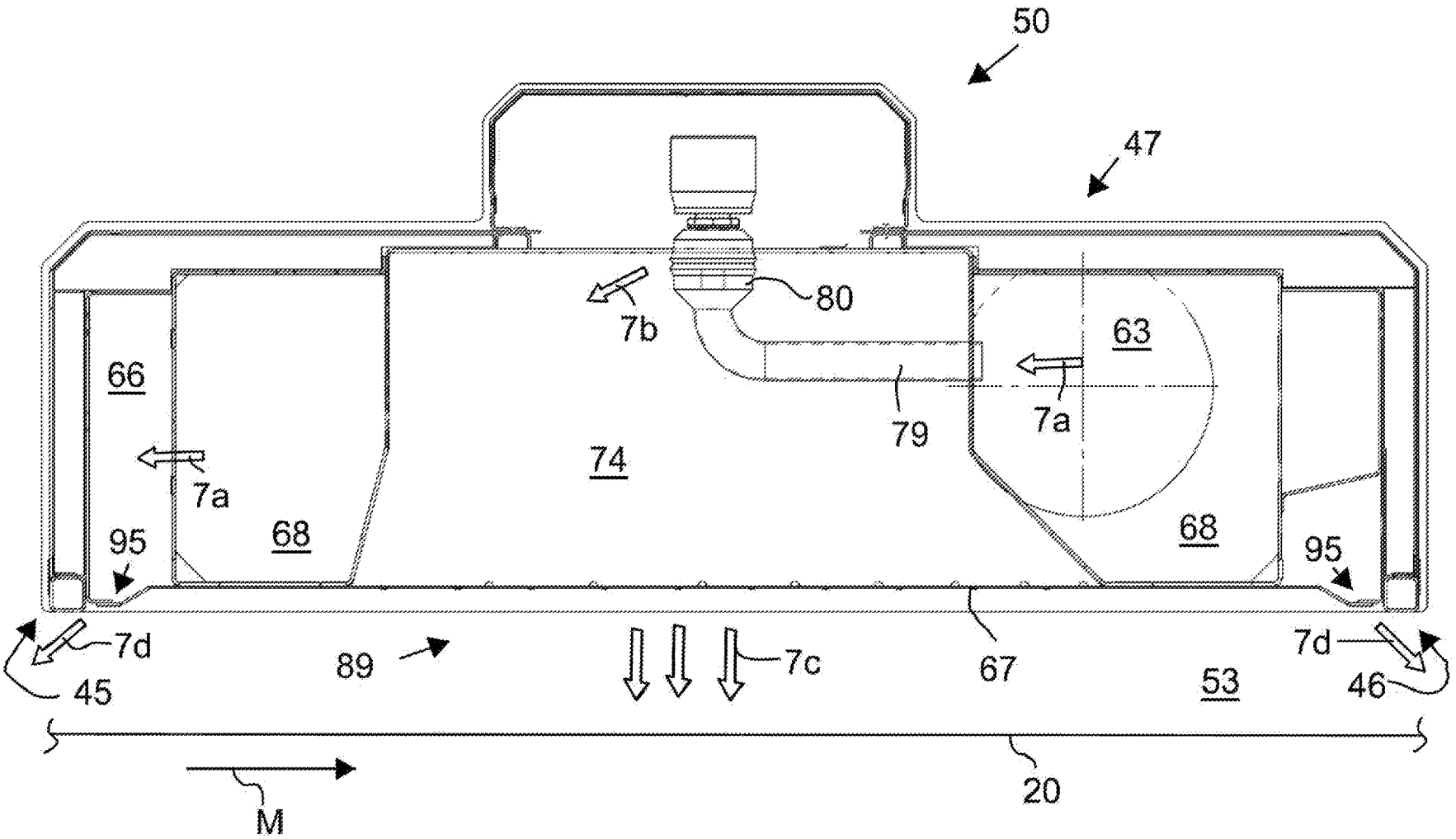
(Prior Art) FIG. 8
FIG. 8 is a cross-sectional side view of a conventional steam box.

FIG. 8 is a cross-sectional side view of a conventional steam box 50. The steam box 50 has a housing 47, a steam inlet 63 disposed in a wall of the housing 47, and a single diffuser chamber 74 enclosed within the housing 47. In operation, steam 7*a* from a steam source flows into a steam header 68 from the steam inlet 63. The steam 7*a* then flows into one or more valve conduits 79. Each valve conduit 79 connects to a valve 80 and thereby fluidly communicates with the valve 80. Multiple valves 80 can extend along the width of the steam box 50 in the cross-machine direction ("CD," see FIG. 2). In different operational states, the depicted valves have a fully open position, a partially open position, and a fully closed position. If the valve 80 is fully open, all steam 7*b* traversing the valve 80 exits the valve 80 into the single diffuser chamber 74. The steam pressure in the steam header 68 is regulated by a pressure control valve (see 77, FIG. 9) disposed in the steam supply line (see 76, FIG. 9) upstream of the steam box 50. The pressure control valve 77 regulates the amount of steam flow 7*a* entering the steam box 50. If steam 7*a* is entering the steam box 50, the valve 80 regulates amount of steam 7*c* exiting the steam box 50. The steam supply system (78, FIG. 9) regulates the pressure in the steam header 68, the steam's temperature, provides over-pressure safety relief, and removes condensate from the steam entering the steam box 50 (see FIG. 9).

The portion of the steam 7*b* that flows into the diffuser chamber 74 accumulates in the diffuser chamber 74 before exiting an exhaust side 89 of the steam box 50 through steam exhaust orifices 67. The steam 7*c* that exits through the exhaust orifices 67 may contact the moving web 20 disposed below the steam box. A layer of air 53 is disposed between the exhaust side 89 of the steam box 50 and the web 20.

A portion of the steam 7*a* diffuses into an outer steam header 66 from the steam header 68. This steam 7*d* then exits the steam box 50 near the upstream end 45 and the downstream end 46 of the steam box 50 at an angle to seal in the steam 7*c* that exits the steam box 50 through the exhaust orifices 67. This angled steam jet 7*d* effectively traps the steam 7*c* between the exhaust side 89 of the steam box 50 and the moving web 20. This allows for appreciable "dwell time" of the steam 7*c* between the exhaust side 89 and the web 20, which permits more steam 7*c* to diffuse into the web 20. However, the presence of the outer steam header 66 for the angled exhaust orifices 95 through which the angled steam 7*d* flows adds extra material to the steam box 50, thereby making the steam box 50 bulky, which can contribute to positioning restrictions within a paper or tissue making machine. The angled steam jet 7*d* is also a further source of steam expenditure.

The web 20 moves in direction M. A sensor (see 65, FIG. 6) can be disposed downstream of the steam box 50. The sensor 65 measures the moisture content of the web 20 and relays the measurement information to a controller (see 69, FIG. 6). The sensor 65 provides a CD moisture profile of the web 20. If there are CD variations in the web's moisture profile (e.g. if portions of the web are too wet or too dry), operators or algorithms can open, close, and partially open valves 80 arrayed along the CD in the steam box 50 to attempt to equalize the moisture profile.

However, steam boxes 50 like the steam boxes 50 depicted in FIG. 8, are designed to have steam 7*c* exit these exhaust orifices 67 consistently at 100% of the design-rated exit flow capacity. For example, if the steam box is rated to introduce steam 7*c* into the web at a rate of 200 kilograms ("kg") per ton ("T") of paper (or tissue) produced, ideal production assumptions can only be met if the steam is exiting the steam box at a rate of 200 kg/T of paper (or tissue) produced.

When an operator or algorithm partially closes a valve 80 (such that the valve 80 is in a partially open position) to attempt to equalize the web's moisture profile in response to sensor readings, the operator or algorithm not only reduces the amount of exiting steam 7*c* (expressed as a percentage of the design-rated exit flow), but the operator or algorithm also increases the time required for the remaining steam 7*b* entering the single diffuser box 74 to reach the steam exhaust orifices 67. Furthermore, when an operator or algorithm partially closes a valve 80, the operator or algorithm also increases the time required for the steam 7*c* exiting the steam exhaust orifices 67 to travel to the moving web 20. As such, the steam 7*c* exits the exhaust side 89 of the steam box 50 not only at an amount that is below the design-rated capacity (the design-rated capacity capable as being expressed in kg/T of paper produced), but the steam 7*c* also exits the exhaust side 89 of the steam box 50 at a lower speed. As a result, the paper or tissue producer expends more energy to produce less paper or tissue product.

The design of the steam box 50 in FIG. 8 also can also lead to other problems. For example, if the speed, and therefore the impulse of the steam 7*c* exiting the steam box 50 is too low, the steam 7*c* will not penetrate the layer or air 53 disposed between the exhaust side 89 of the steam box 50 and the web 20. When this happens, the steam box 50 is not effectively drying the web 20 and the energy is wasted. Lower steam exit speeds also allow steam 7*c* to diffuse more in the layer of air 53 before reaching the web 20. As a result, an operator's ability to target a desired section of the web 20 degrades as steam exit speed decreases.

Conversely, if the impulse of the steam 7*c* is too high, the steam will destroy the surface of the web 20. This can render this surface unsuitable for receiving coatings downstream, which can eventually render the paper unsuitable for printing. If the steam impulse is too great, the steam can also accumulate in areas of higher pressure over the web 20, thereby re-directing incoming steam to untargeted areas of the web, and causing some of the steam 7*c* to flow back toward the exhaust side 89 of the steam box 50 without interacting with the web 20. This steam blowback also increases energy consumption and waste.

The Applicant has discovered that the steam output of conventional steam boxes drops off in a non-linear manner. To address the problems of conventional steam boxes 50, Applicant details several exemplary embodiments in accordance with the present disclosure.

FIG. 1 is a cross-sectional view of an exemplary embodiment of a steam box 1 in accordance with the present disclosure. The steam box 1 comprises a steam box housing 3 and a steam header 5 disposed within the steam box housing 3. Steam 7*a* from the steam inlet (21 in FIG. 6) collects in the steam header 5. The steam box 1 further comprises a diffuser housing 9 disposed within the steam header 5. The diffuser housing 9 has multiple walls 8 that extend from the top of the diffuser housing 9. The multiple walls 8 divide an inside 10 of the diffuser housing 9 into multiple diffuser chambers see 10*a*, 10*b*, 10*c*, 10*d* arranged adjacently in the machine direction ("MD"), and thereby define multiple diffuser chambers. The multiple diffuser chambers comprise at least a first diffuser chamber 10*a* and a second diffuser chamber 10*b*. The first diffuser chamber 10*a* is adjacently disposed to the second diffuser chamber 10*b* in the MD. The steam box 1 is disposed above a fibrous web 20 (e.g. which later dries through further processing into a sheet of paper, tissue, or other non-woven sheet of fibrous material depending upon the production equipment and feed stock).

Figure 5:
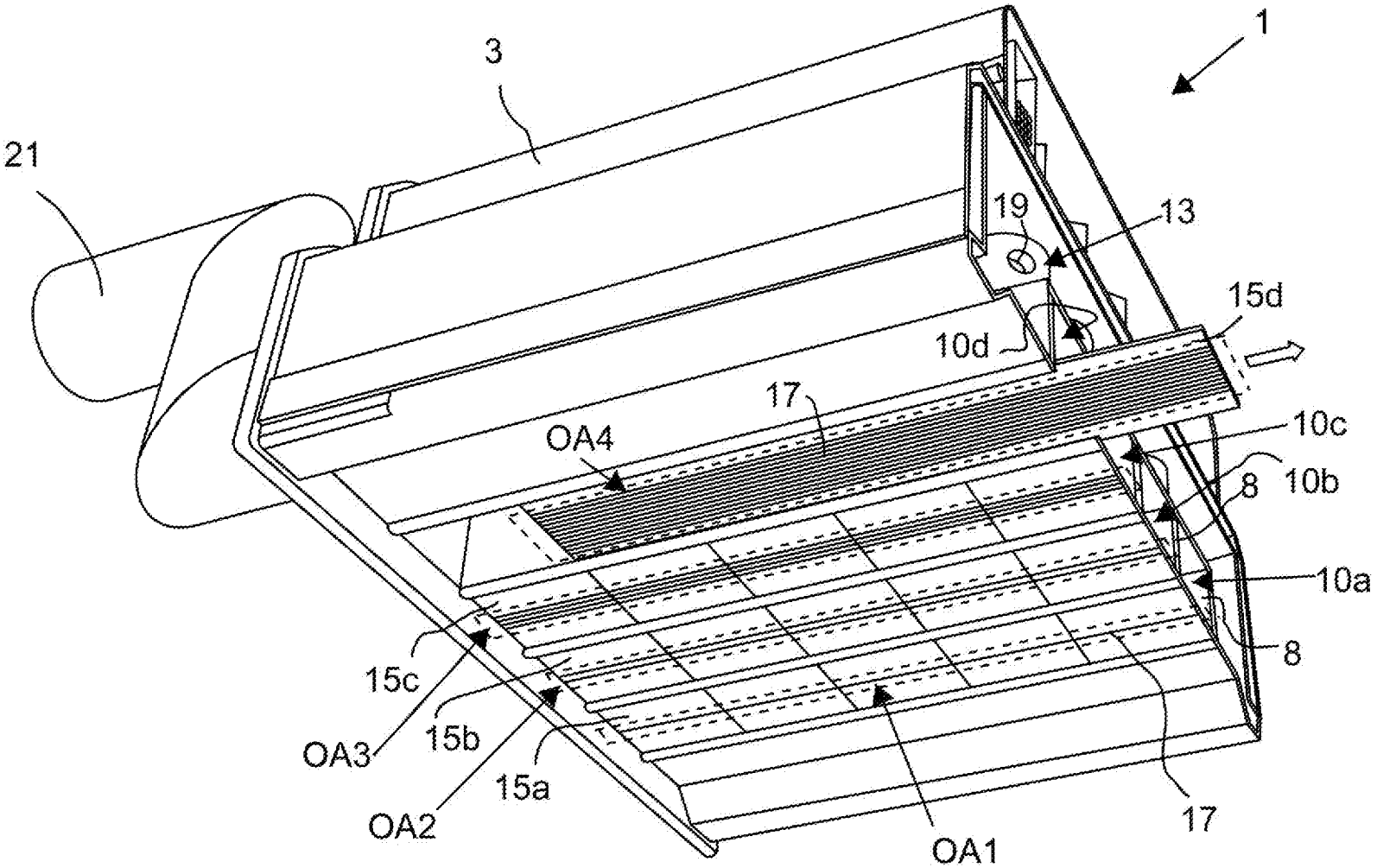
FIG. 5 is a bottom-up perspective view showing the removable diffuser plates.

Each diffuser chamber 10*a*, 10*b*, 10*c*, 10*d* extends generally lengthwise in the CD. The steam box housing 3 may define ends (not depicted in the cross-sectional view) of the diffuser chambers 10*a*, 10*b*, 10*c*, 10*d*. A diffuser plate 15 (see also 15*a*, 15*b*, 15*c*, 15*d*) engages the steam box 1 distal from the top 6 of the diffuser housing 9 and adjacent to the multiple diffuser chambers 10*a*, 10*b*, 10*c*, 10*d* to define an exhaust side 89 of the steam box 1. The diffuser chambers 10*a*, 10*b*, 10*c*, 10*d* extend to the diffuser plate 15 and therefore the exhaust side 89 of the steam box 1. The diffuser plate 15 can further define any of the diffuser chambers 10*a*, 10*b*, 10*c*, 10*d*. In certain exemplary embodiments, the diffuser plate 15 can be a single diffuser plate 15 having orifices 17 that define multiple steam exhaust orifice areas OAs (FIG. 5). In such embodiments, a first steam exhaust orifice area OA1 is disposed at the exhaust side 89 adjacent to the first diffuser chamber 10*a*. A second steam exhaust orifice area OA2 is disposed at the exhaust side 89 adjacent to the second diffuser chamber 10*b*. In such embodiments that comprise more than two diffuser chambers, a steam exhaust orifice area OAz is disposed at the exhaust side 89 adjacent to the z diffuser chamber, where "z" is the number of the diffuser chamber. In other exemplary embodiments, a diffuser plate 15 can be disposed under two or more diffuser chambers 10*a*, 10*b*, etc. In the depicted embodiment, a different diffuser plate 15*a*, 15*b*, 15*c*, 15*d*, is disposed under a different diffuser chamber 10*a*, 10*b*, 10*c*, 10*d* (i.e. a first diffuser plate 15*a* is disposed under a first diffuser chamber 10*a*, a second diffuser plate 15*b* is disposed under a second diffuser chamber 10*b*, etc.

Multiple valves 13 can be disposed on the top 6 of the diffuser housing 9 such that each valve 13 fluidly communicates with at least one of the diffuser chambers 10*a*, 10*b*, 10*c*, 10*d*. Each valve (e.g. see FIG. 2, 13*a*1, 13*a*2, 13*a*3, 13*a*4, 13*b*1, 13*b*2, 13*b*3, 13*b*4, 13*c*1, 13*c*2, 13*c*3, 13*c*4, 13*d*1, 13*d*2, 13*d*3, 13*d*4) of the multiple valves 13 has a valve outlet 22. For the purposes of this disclosure, a particular valve (e.g. 13*a*1) or set of valves (e.g. 13*a*) disposed over a particular diffuser chamber (e.g. 10*a*) can be referred to as a valve (e.g. 13*a*1) or set of valves (e.g. 13*a*) of said diffuser chamber 10*a*. The diffuser plate 15 has one or more steam exhaust orifices 17 through which the steam 7*c* may flow when the valves 13 are in an open position. Unlike in prior steam boxes, the valves 13 of the present disclosure are configured to be either fully open (i.e. 100% open; the "open position") or fully closed, (i.e. 0% open; the "closed position"). When a valve is in the fully open position, steam 7*b* flows into the diffuser chamber (e.g. 10*a*, 10*b*, 10*c*, 10*d*) over which the valve 13 is disposed.

Figure 3:
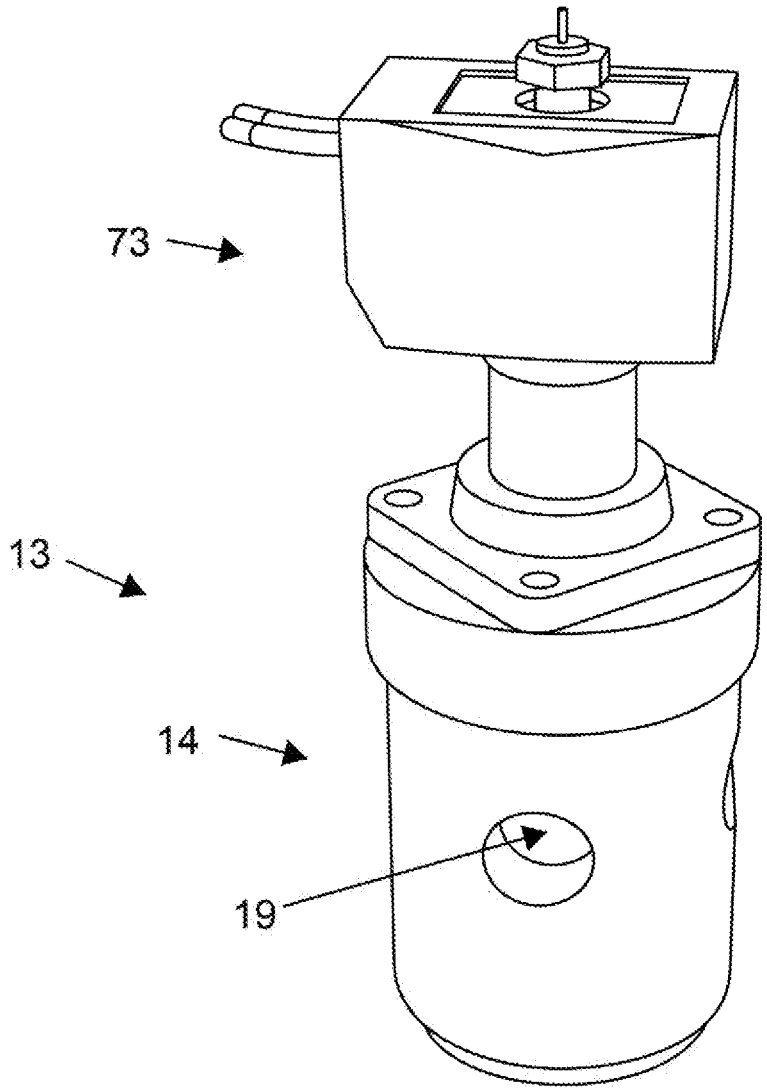
FIG. 3 is a view of a valve used with the exemplary steam box and exemplary system.

In certain exemplary embodiments, the valve 13 may be a solenoid valve (see FIG. 3). When the valve is in an open position, steam 7*a* flows from the steam header 5 through a valve orifice 19 and out of the valve outlet 22 into one of the multiple diffuser chambers 10*a*, 10*b*, 10*c*, 10*d*. In this manner, a valve 13 can be said to "fluidly communicate" with a diffuser chamber. It is contemplated that in certain exemplary embodiments, the size of the valve orifice 19 may vary to optimize the flow of steam 7*a* from the steam header 5 into a specific diffuser chamber 10*a*, 10*b*, 10*c*, 10*d*.

In certain exemplary embodiments, there are multiple diffuser plates 15. In these embodiments, each diffuser plate 15*a*, 15*b*, 15*c*, 15*d* preferably aligns with a diffuser chamber 10*a*, 10*b*, 10*c*, 10*d*. That is, in the depicted embodiment, the top 6 of the diffuser housing 9, the walls 8 of the diffuser housing 9, and a first diffuser plate 15*a* of the plurality of diffuser plates 15 define a first diffuser chamber 10*a* in the diffuser housing 9. The top 6 of the diffuser housing 9, the walls 8 of the diffuser housing 9, and a second diffuser plate 15*b* of the plurality of diffuser plates 15 define a second diffuser chamber 10*b* in the diffuser housing 9. The top 6 of the diffuser housing 9, the walls 8 of the diffuser housing 9, and a third diffuser plate 15*c* of the plurality of diffuser plates 15 define a third diffuser chamber 10*c* in the diffuser housing 9. The top 6 of the diffuser housing 9, the walls 8 of the diffuser housing 9, and a fourth diffuser plate 15*d* of the plurality of diffuser plates 15 define a fourth diffuser chamber 10*d* in the diffuser housing 9. In embodiments comprising five diffuser chambers (not depicted), the top 6 of the diffuser housing 9, the walls 8 of the diffuser housing 9, and a fifth diffuser plate of the plurality of diffuser plates can define a fifth diffuser chamber in the diffuser housing 9. In embodiments comprising more than five diffuser chambers, the top 6 of the diffuser housing 9, the walls 8 of the diffuser housing 9, and a "y-th" diffuser plate of the plurality of diffuser plates can define a "y-th" diffuser chamber in the diffuser housing 9, wherein "y" is the number of the indicated diffuser chamber.

A first valve outlet 22*a* of at least a first valve 13*a*1 of the multiple valves 13 is disposed in the first diffuser chamber 10*a*. Steam 7*a* can pass from the steam header 5 through the valve (e.g. 13*a*1) when the valve (e.g. 13*a*1) is in the open position. In this manner, each of the valves 13 can be configured to fluidly communicate with the valve's respective diffuser chamber 10*a*, 10*b*, 10*c*, 10*d*. In the depicted embodiment, at least a second valve 13*b* fluidly communicates with the second diffuser chamber 10*b*. Likewise, at least a third valve 13*c* fluidly communicates with the third diffuser chamber 10*c* and at least a fourth valve 13*d* fluidly communicates with the fourth diffuser chamber 10*d*. In embodiments comprising five diffuser chambers, at least a fifth valve can fluidly communicate with the fifth diffuser chamber. In embodiments comprising more than five diffuser chambers, a "y-th" valve fluidly communicates with the "y-th" diffuser chamber, wherein "y" is the number of the indicated diffuser chamber.

The number of steam exhaust orifices 17 per diffuser plate 15 varies depending upon the desired capacity of steam 7*c* exiting a given diffuser chamber 10*a*, 10*b*, 10*c*, 10*d*. For example, as better seen in FIG. 5, the first diffuser plate 15*a* defines a first steam exhaust orifice area OA1 (represented schematically and not to scale by the area inside the rectangle OA1). The first steam exhaust orifice area OA1 has a first value. In the depicted exemplary embodiment, the first diffuser plate 15*a* defines the first steam exhaust orifice area OA1 with a single linear steam exhaust orifice 17. It will be understood that in other exemplary embodiments, the steam exhaust orifice(s) 17 may assume a variety of shapes. For example, the steam exhaust orifice(s) 17 may be a plurality of holes. The steam exhaust orifices 17 may be arranged in any pattern, or lack thereof in the diffuser plate 15. The "steam exhaust orifice area" represents the total area occupied by steam exhaust orifice(s) 17 for the steam exhaust orifice(s) 17 disposed under a given diffuser chamber 10*a*, 10*b*, 10*c*, 10*d*. In certain exemplary embodiments, the steam exhaust orifices(s) 17 can be disposed at an angle such that the steam 7*c* does not exit the exhaust side 89 substantially perpendicular to the section of the web 20 disposed adjacent to the exhaust side 89 of the steam box 1.

Steam 7*b* that collects in the first diffuser chamber 10*a* moves from an area of higher pressure to an area of lower pressure and thereby exits the first diffuser chamber 10*a* through the first steam exhaust orifice area OA1. In this manner, the diffuser chambers 10*a*, 10*b*, 10*c*, 10*d* and diffuser plates 15*a*, 15*b*, 15*c*, 15*d* are configured to expel steam 7*c* into the moving web 20. The value of the first steam exhaust orifice area OA1 can be represented by "v."

The second diffuser plate 15*b* defines a second steam exhaust orifice area OA2 (FIG. 5). The second steam exhaust orifice area OA2 has a second value. The second value is equal to an exponentiation $v^n$, wherein "v" is the first value, and "n" is a real number excluding 0.

For example, in FIG. 1 and FIG. 5, $v^n$ is a power of 2. The first value of the first steam exhaust orifice area OA1 is $v^0$ where v=2. Stated differently, $2^0=1$. The second value of the second steam exhaust orifice area OA2 is $v^1$ where v=2. Stated differently, $2^1=2$. The third value of the third steam exhaust orifice area OA3 is $v^2$ where v=2. Stated differently, $2^2=4$. The fourth value of the fourth steam exhaust orifice area OA4 is $v^3$ where v=2. Stated differently, $2^3=8$.

Although FIG. 1 and FIG. 5 depict diffuser plates 15*d*, 15*c*, 15*b*, 15*a* having a number of steam exhaust orifices 17 decreasing from 8, to 4, to 2, to 1 as the web 20 moves from the upstream end 45 to the downstream end 46, it will be understood that in other exemplary embodiments, operators may re-position the diffuser plates (see 15*d*, 15*c*, 15*b*, 15*a*) to accommodate the properties of a particular paper web 20. For example, an exemplary embodiment may have diffusers plates 15 having steam exhaust orifice areas OAs arranged respectively from 4, to 8, to 1, to 2 from the upstream end 45 to the downstream end 46. Still other exemplary embodiments may arrange the diffuser plates 15 having steam exhaust orifice areas OAs arranged respectively from 4, to 4, to 4, to 2. In other exemplary embodiments, the values of the steam exhaust orifice areas OAs are equal to the exponentiation $v^n$, but the exponentiation $v^n$ is a power of 3. In yet other exemplary embodiments, the exponentiation $v^n$ can have values other that powers of 2 and powers of 3. Combinations and permutations of any of the described embodiments or examples are within the scope of this disclosure.

Without being bound by theory, Applicant believes that exemplary embodiments in accordance with the present disclosure separate the properties of steam capacity (also known as the amount of available steam to be introduced into the web 20) and steam speed. Steam boxes 1 in accordance with the present disclosure permit controlled variation of the amount of available steam available to be ejected from the steam exhaust orifices 17 without varying the speed at which steam 7*c* is ejected from active diffuser chambers 10.

It is envisioned that steam exiting a steam box 1 in accordance with the present disclosure can constantly penetrate the web 20 at a desirably constant speed and thereby give proper zone definition without steam spilling into other zones. For example, in certain exemplary embodiments wherein the web 20 is a paper web, an exemplary steam box 1 can be configured to expel steam from active diffuser chambers 10 at a rate of 27 meters per second ("m/s"). In exemplary embodiments wherein the web 20 is a tissue web, an exemplary steam box 1 can be configured to expel steam from active diffuser chambers 10 at a rate of 1.4 times the web speed. For example, if the web moves by the steam box 1 at a rate of between 1,000 to 1,800 meters per minute ("m/min."), the steam box 1 can expel steam 7*c* at a rate of between 23⅓ m/s-42 m/s.

Referring to the embodiment depicted in FIG. 1, the capacity of the depicted diffuser chambers 10*a*, 10*b*, 10*c*, 10*d* when all the valves 13 are in the open position is 100% of the design-rated steam output capacity. If readings from the CD moisture profile sensor 65 indicate that the web 20 is dryer than expected, operators or algorithms can close all the valves disposed over a certain diffuser chamber to reduce the available steam 7*c* and thereby avoid waste.

For example, if the CD moisture profile sensor 65 indicates that more than 40% to 46⅔% of the maximum steam capacity is sufficient to dry a particular section of the web 20, operators or algorithms can open the valves 13 disposed over the first diffuser chamber 10*a*, the second diffuser chamber 10*b*, and the third diffuser chamber 10*c* while closing the valves disposed over the fourth diffuser chamber 10*d*. The valves 13 over the active diffuser chambers 10*a*, 10*b*, 10*c* are fully open; therefore, the steam 7*c* exits the exhaust orifices 17 of the first, second, and third diffuser chambers 10*a*, 10*b*, 10*c* at a constant speed. Stated differently, the steam 7*c* exiting the active diffuser chambers 10*a*, 10*b*, 10*c* travels the same distance toward the web 20 over a given time. The speed at which the steam 7*c* exits the active diffuser chambers 10*a*, 10*b*, 10*c* is desirably calibrated to penetrate the web 20 and to be fully absorbed by the web 20 (i.e. to condense in the web 20 nearly completely). By maintaining the speed at which the steam 7*c* is introduced into the web 20, it is contemplated that the steam can maintain a nearly constant impulse sufficient to penetrate the laminate layer or air 53 disposed between the exhaust side 89 and the web 20, while giving operators greater control over increasing or decreasing the web temperature at more precise positions than was previously thought possible. The different capacities of steam leaving different active diffuser chambers (e.g. 10*a* and 10*b*) have the same impulse, and thereby separate the properties of steam capacity from steam speed.

The steam 7*c* condensing in the web 20 raises the temperature of water entrapped in the web, thereby lowering the water's viscosity and facilitating of the removal of the liquid, which now includes the condensed steam 7*c*, via a vacuum source in the press section. For this reason, the temperature of the steam can desirably be just above the boiling temperature of water adjusted for pressure. Stated simply, the lower the viscosity of the liquid in the web 20, the more liquid the vacuum source in the press section can remove. In this manner, the embodiments in accordance with the present disclosure allow the reduction of available steam capacity without altering the speed at which the remaining steam 7*c* exits the exhaust orifices 17.

The steam capacity of given diffuser chamber 10*a*, 10*b*, 10*c*, 10*d* depends upon the available steam exhaust orifice area OA of the diffuser plates 15*a*, 15*b*, 15*c*, 15*d*. The more available steam exhaust orifice area OA (represented practically by the number of orifices in FIG. 1) the greater capacity that diffuser chamber 10*a*, 10*b*, 10*c*, 10*d* will have to transmit steam 7*b*, 7*c*.

In the depicted embodiment, the first diffuser plate 15*a* has the smallest first steam exhaust orifice area OA. When the first set of valves 15*a* are fully open, steam 7*c* exits the first diffuser chamber 10*a* through the first diffuser plate 15*a* at a rate of 1x, where "x" is the first diffuser chamber's steam capacity. Steam capacity can be expressed in kilograms per hour ("kg/hr") or as a percentage of the steam box's total steam capacity.

The second diffuser plate 15*b* has orifices 17 configured to expel steam at a steam capacity rate of 2x. The third diffuser plate 15*c* has orifices 17 configured to expel steam at a steam capacity rate of 4x. The fourth diffuser plate 15*d* has orifices 17 configured to expel steam at a steam capacity rate of 8x. Other exemplary embodiments can have more than four diffuser chambers. Still other exemplary embodiments can have two diffuser chambers. Yet other exemplary embodiments can have three diffuser chambers.

It will be appreciated that in any of the diffuser plates 15*a*, 15*b*, 15*c*, 15*d*, can comprise multiple steam exhaust orifices 17. The multiple steam exhaust orifices 17 may be arranged in any manner provided that the collective multiple orifices 17 of each diffuser plate 15*a*, 15*b*, 15*c*, 15*d* is configured to expel steam from a diffuser chamber 10*a*, 10*b*, 10*c*, 10*d* at a steam capacity rate that is a multiple of x. For example, FIG. 5 depicts multiple orifices 17 for each diffuser plates disposed in a line or in a series of lines.

A steam box controller (69, FIG. 6 and FIG. 9) signally communicates with each of the valves 13. The steam box controller 69 sets the valves into the open position or the closed position. It is contemplated that the exemplary embodiments will permit a constant steam speed while allowing operators to vary the amount of available steam (i.e. steam capacity) based on need. For example, with four diffuser chambers 10*a*, 10*b*, 10*c*, 10*d*, an operator can control the steam capacity rate from 0% to 100% in 15 steps of selectively turning on and off the valves 13 associated with each of the four diffuser chambers 10*a*, 10*b*, 10*c*, 10*d*. For example, a first diffuser plate 15*a* can have an orifice 17 designed to permit steam 7*c* to exit the first diffuser plate 15*a* toward the web 20 at a steam capacity of 1x, where "x" is the first diffuser chamber's steam capacity. A second diffuser plate 15*b* can then be designed to have an exit steam capacity of 2x. A third diffuser plate 15*c* can be designed to have an exit steam capacity of 4x. A fourth diffuser plate 15*d* can be designed to have an exit steam capacity of 8x. The steam box controller 69 can be programed to count in a base two system to selectively open and close the valves 13*a*, 13*b*, 13*c*, 13*d* associated with the first 10*a*, second 10*b*, third 10*c*, and fourth 10*d* diffuser chambers respectively. In this manner, the steam box controller 69 can effectively count in binary to selectively open and close valves 13 to allow steam 7 to flow out of at least one diffuser orifice 17 are a rate between 0% and 100%.

With exemplary embodiments comprising four diffuser chambers, 10*a*, 10*b*, 10*c*, 10*d*, the operator can control the amount of steam 7*c* ejected into the web 20 as a percentage of the steam box's total steam capacity (i.e. 100%) while ensuring that the amount of steam ejected toward the moving web 20 is ejected at a constant speed, thereby ensuring good penetration and good zone definition. Good zone definition (e.g. both CD zone and MD zone definition) prevents steam from diffusing into adjacent zones that may not need additional drying.

For example, in an exemplary steam box 1 having four diffuser chambers, 10*a*, 10*b*, 10*c*, 10*d*, "x" is 6⅔% of total possible steam output. Stated differently, 6⅔% is the steam capacity of the first diffuser chamber 10*a* when the set of valves 13*a* disposed above the first diffuser chamber 10*a* are in the open position. Stated yet another way, 6⅔% is the resolution of steam capacity changes in the depicted exemplary embodiment. If the operator or algorithm elects to introduce steam 7*c* into the web at a rate of 6⅔% of the steam box's total steam capacity, the operator or algorithm will open the set of valves 13*a* disposed above the first diffuser chamber 10*a*. In embodiments wherein the steam box 1 comprises four diffuser chambers, opening only the set of valves 13*a* disposed above the first diffuser chamber 10*a* is referred to as "Step 1". In the depicted embodiment, a total of sixteen steps (i.e. fifteen steps plus a step 0) are available to permit the exemplary system to change the operating steam capacity (expressed as a percentage of the steam box's maximum design-rated steam capacity) depending upon web moisture profile variations while ensuring that the speed of steam output for any of the selected total amount of steam output remains constant. The below table details the sixteen steps, each step's actual steam output (i.e. the steam box's operating steam capacity associated with each step, expressed as a percentage of the steam box's maximum design-rated steam capacity), and the corresponding diffuser chambers that have valves 13 in the open position. It will be understood that "active diffuser chamber" means a diffuser chamber for which the valves 13 disposed over said diffuser chamber are in the open position.

TABLE 1

| Steam Capacity Target Range from the CD Control Software [%] | Step Number | Step Number in Binary | Active Diffuser Chambers | Actual Steam Capacity Output [%] |
|---|---|---|---|---|
| 0-3⅓ | 0 | 0 | none | 0 |
| >3⅓-10 | 1 | 1 | 10a | 6⅔ |
| >10-16⅔ | 2 | 10 | 10b | 13⅓ |
| >16⅔-23⅓ | 3 | 11 | 10b, 10a | 20 |
| >23⅓-30 | 4 | 100 | 10c | 26⅔ |
| >30-36⅔ | 5 | 101 | 10c, 10a | 33⅓ |
| >36⅔-43⅓ | 6 | 110 | 10c, 10b | 40 |
| >43⅓-50 | 7 | 111 | 10c, 10b, 10a | 46⅔ |
| >50-56⅔ | 8 | 1000 | 10d | 53⅓ |
| >56⅔-63⅓ | 9 | 1001 | 10d, 10a | 60 |
| >63⅓-70 | 10 | 1010 | 10d, 10b | 66⅔ |
| >70-76⅔ | 11 | 1011 | 10d, 10b, 10a | 73⅓ |
| >76⅔-83⅓ | 12 | 1100 | 10d, 10c | 80 |
| >83⅓-90 | 13 | 1101 | 10d, 10c, 10a | 86⅔ |
| >90-96⅔ | 14 | 1110 | 10d, 10c, 10b | 93⅓ |
| >96⅔-100 | 15 | 1111 | 10d, 10c, 10b, 10a | 100 |

Other exemplary steam boxes 1 can have five or more diffuser chambers. In a steam box 1 having five diffuser chambers for example, the resolution of the change in available steam flow output is 3.22580645%. It will be understood that "active diffuser chamber" means a diffuser chamber for which the valves disposed over said diffuser chamber are in the open position. The first diffuser chamber (see 10*a*), second diffuser chamber (see 10*b*), third diffuser chamber (see 10*c*), fourth diffuser chamber (see 10*d*), and fifth diffuser chamber are abbreviated 1, 2, 3, 4, and 5 respectively in the below Table 2. The resolution of 3.22580645% has been rounded to three significant figures in the below table.

TABLE 2

| Steam Capacity Target Range from the CD Control Software [%] | Step Number | Step Number in Binary | Active Diffuser Chambers | Actual Steam Capacity Output [%] |
|---|---|---|---|---|
| 0-1.6 | 0 | 0 | none | 0 |
| >1.6-4.83 | 1 | 1 | 1 | 3.23 |
| >4.83-8.06 | 2 | 10 | 2 | 6.46 |

TABLE 2-continued

| Steam Capacity Target Range from the CD Control Software [%] | Step Number | Step Number in Binary | Active Diffuser Chambers | Actual Steam Capacity Output [%] |
|---|---|---|---|---|
| >8.06-11.29 | 3 | 11 | 2, 1 | 9.69 |
| >11.29-14.52 | 4 | 100 | 3 | 12.92 |
| >14.52-17.75 | 5 | 101 | 3, 1 | 16.15 |
| >17.75-20.98 | 6 | 110 | 3, 2 | 19.38 |
| >20.98-24.21 | 7 | 111 | 3, 2, 1 | 22.61 |
| >24.21-27.44 | 8 | 1000 | 4 | 25.84 |
| >27.44-30.67 | 9 | 1001 | 4, 1 | 29.07 |
| >30.67-33.90 | 10 | 1010 | 4, 2 | 32.3 |
| >33.90-37.13 | 11 | 1011 | 4, 2, 1 | 35.53 |
| >37.13-40.36 | 12 | 1100 | 4, 3 | 38.76 |
| >40.36-43.59 | 13 | 1101 | 4, 3, 1 | 41.99 |
| >43.59-46.82 | 14 | 1110 | 4, 3, 2 | 45.22 |
| >46.82-50.05 | 15 | 1111 | 4, 3, 2, 1 | 48.45 |
| >50.05-53.28 | 16 | 10000 | 5 | 51.68 |
| >53.28-56.51 | 17 | 10001 | 5, 1 | 54.91 |
| >56.51-59.74 | 18 | 10010 | 5, 2 | 58.14 |
| >59.74-62.97 | 19 | 10011 | 5, 2, 1 | 61.37 |
| >62.97-66.20 | 20 | 10100 | 5, 3 | 64.60 |
| >66.20-69.43 | 21 | 10101 | 5, 3, 1 | 67.83 |
| >69.43-72.66 | 22 | 10110 | 5, 3, 2 | 71.06 |
| >72.66-75.89 | 23 | 10111 | 5, 3, 2, 1 | 74.29 |
| >75.89-79.12 | 24 | 11000 | 5, 4 | 77.52 |
| >79.12-82.35 | 25 | 11001 | 5, 4, 1 | 80.75 |
| >82.35-85.58 | 26 | 11010 | 5, 4, 2 | 83.98 |
| >85.58-88.81 | 27 | 11011 | 5, 4, 2, 1 | 87.21 |
| >88.81-92.04 | 28 | 11100 | 5, 4, 3 | 90.44 |
| >92.04-95.27 | 29 | 11101 | 5, 4, 3, 1 | 93.67 |
| >95.27-98.50 | 30 | 11110 | 5, 4, 3, 2 | 96.90 |
| >98.50-100 | 31 | 11111 | 5, 4, 3, 2, 1 | 100 |

Figure 2:
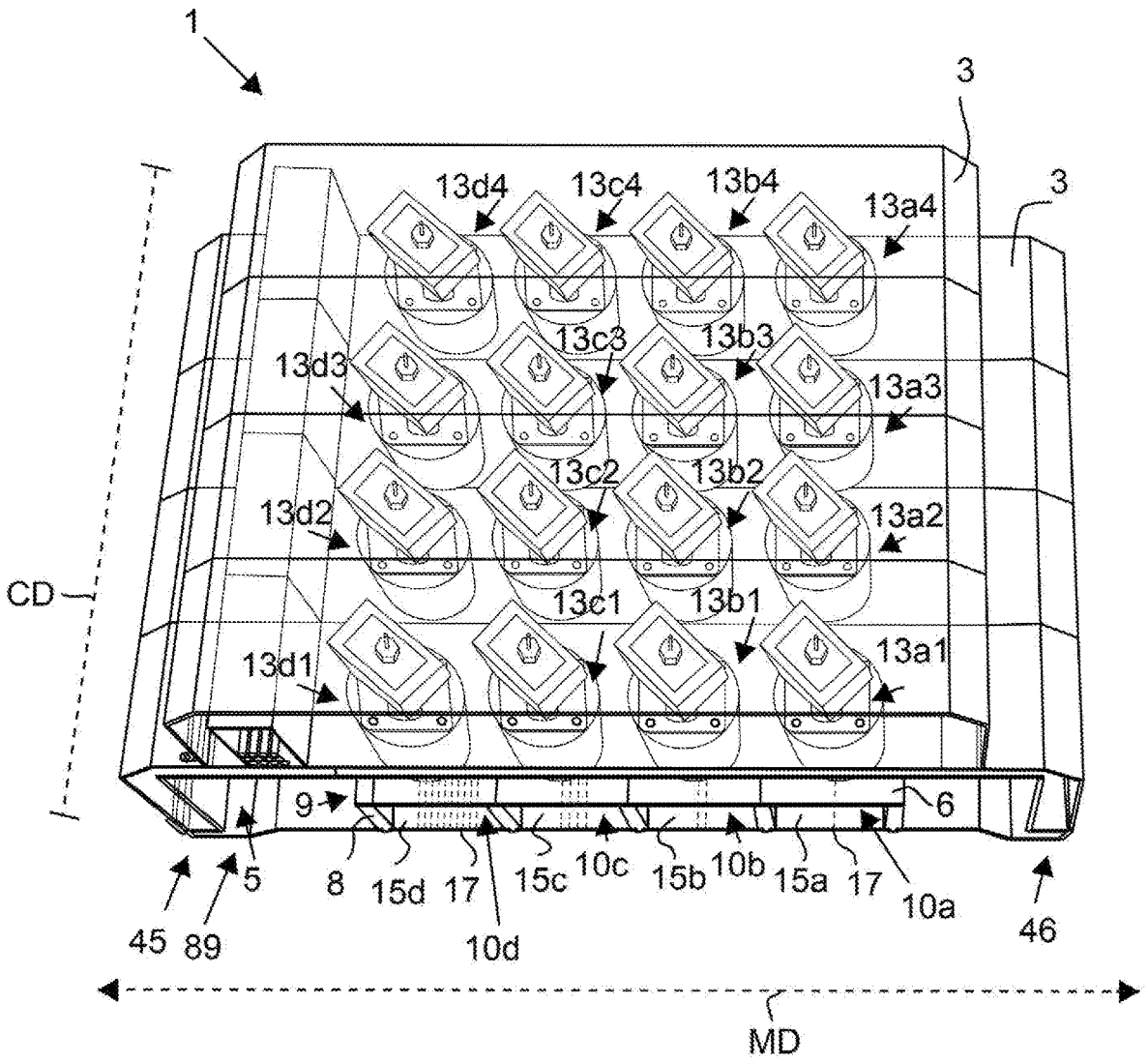
FIG. 2 is a top-down perspective view of an exemplary steam box in accordance with this disclosure.

FIG. 2 is a top-down perspective view of an exemplary steam box 1. FIG. 2 further details the multiple valves 13 fluidly communicating with the diffuser chambers 10*a*, 10*b*, 10*c*, 10*d*. For reference, the set of valves fluidly communicating with the first diffuser chamber 10*a* are designated with the reference character prefix 13*a*. Likewise, the set of valves fluidly communicating with the second diffuser chamber 10*b* are designated with the reference character prefix 13*b* and the set of valves fluidly communicating with the third diffuser chamber 10*c* are designated with the reference character prefix 10*c*. Finally, the set of valves configured to fluidly communicate with the fourth diffuser chamber 10*d* are designated with the reference character prefix 13*d*.

The diffuser chambers 10*a*, 10*b*, 10*c*, 10*d* span substantially the width of the steam box 1 in the CD. Adjacent diffuser chambers (e.g. 10*a* and 10*b*) are arranged in the MD. The area under a diffuser chamber (e.g. 10*a*) defines a MD zone. Each MD zone extends lengthwise in the CD. The multiple valves 13 are further classified by CD zone (e.g. 1, 2, 3, 4 in FIG. 2). Each CD zone extends lengthwise in the MD. Adjacent CD zones (e.g. 1 and 2) are arranged in the CD. For reference, the last number for a valve character reference indicates the CD zone of that valve (e.g. 13*c*3 is in CD zone 3 and MD zone c).

Figure 6:
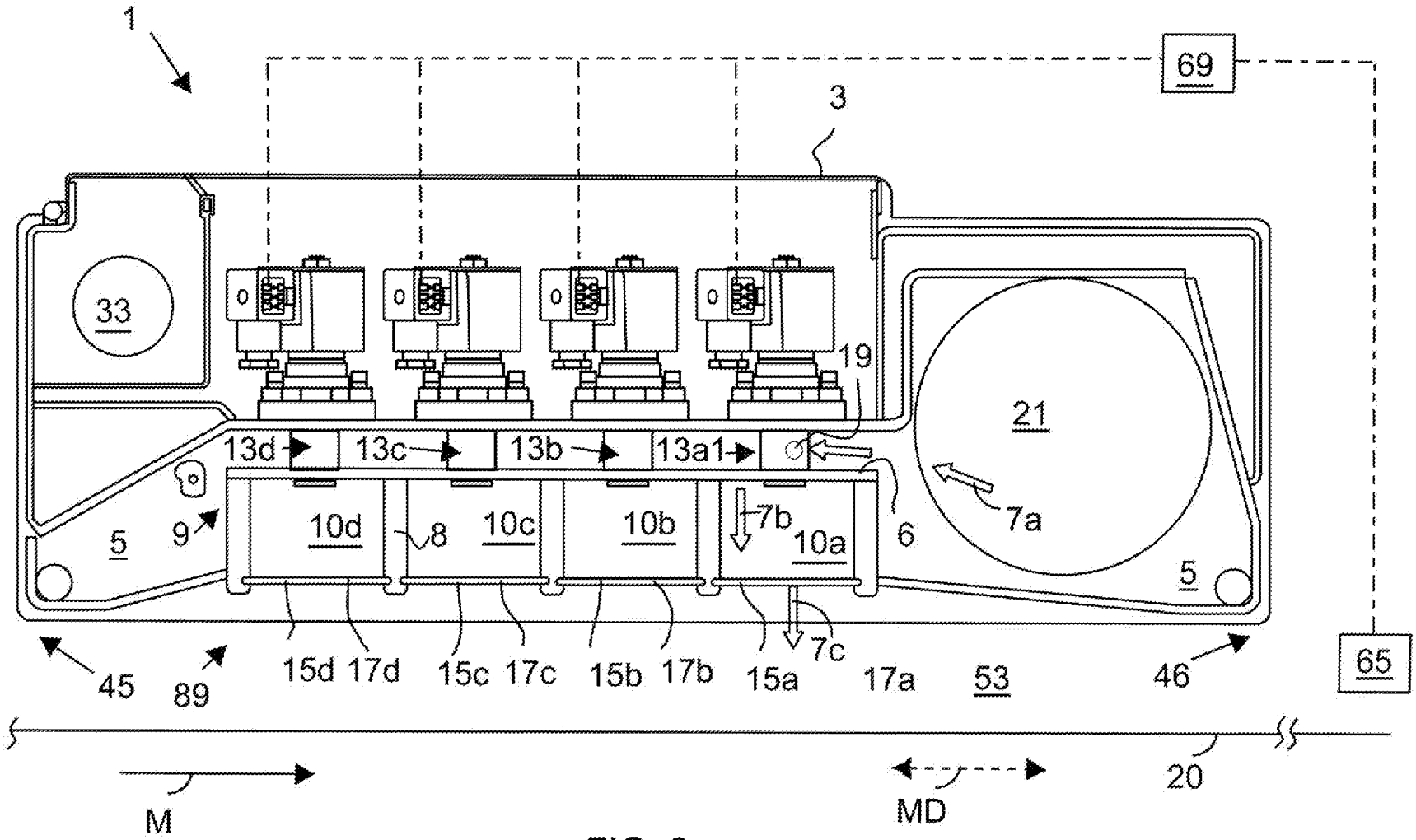
FIG. 6 depicts further cross-sectional view of the exemplary steam boxes and systems described herein.

Referring to FIG. 6, in operation, steam 7*a* enters the housing 3 of the steam box 1 through the steam inlet 21. The steam 7*a* collects in the steam header 5. If any of the valves in a set of valves 13*a*, 13*b*, 13*c*, 13*d*, are in the fully open position, the steam 7*a* will flow through the open valve (e.g. 13*a*1 in FIG. 6) and into the associated diffuser chamber (e.g. the first diffuser chamber 10*a* in FIG. 6). The steam 7*b* then collects in the associated diffuser chamber (e.g. first diffuser chamber 10*a*) before exiting the associated diffuser chamber through the orifices 17 in the associated diffuser plate (e.g. the first diffuser plate 15*a* in FIG. 6). The steam 7*c* desirably exits at a speed sufficient to penetrate the laminate layer of air 53 disposed between the exhaust side 89 of the steam box 1. The steam 7*c* may further exit the steam box 1 at a speed at which the steam 7*c* can fully condense into the moving web 20. Fully condensed steam will heat the water entrapped in the web 20 evenly, lower the water's viscosity, and permit the vacuum source to remove more water in a given time interval than would be possible if the steam 7*c* were not fully condensed in the web 20.

Conduit 33 permits cables from the steam box controller 69 to connect to the valve actuators (see solenoid component 73, FIG. 3).

A sensor 65 can be disposed downstream of the downstream end 46 of the steam box 1. The sensor 65 can be a CD moisture sensor configured to measure the CD moisture profile of the web. The sensor 65 signally communicates with a controller 69. That is, the sensor 65 can convey the measurement to the controller 69 via a signal through an electrical conduit (e.g. a conductive wire) or wirelessly.

The CD moisture profile generally represents the CD moisture profile of the web 20 at a given time. The CD moisture profile typically indicates the moisture of the web 20 at CD zones that correspond to the CD zones (e.g. 1, 2, 3, 4 in FIG. 2) of the steam box 1. The controller 69 will evaluate the signal from the sensor 65 and adjust the open or closed position of the valves 13 to equalize the CD moisture profile.

For example, if the moisture profile of CD zone 2 is wetter than CD zones 1 or 3, the controller 69 will open one or more valves in CD zone 2 (e.g. one of more of 13*a*2, 13*b*2, 13*c*2, 13*d*2 in FIG. 2) to equalize the moisture profile and thereby promote even and consistent drying of the web 20.

By way of a further example, if a particular CD moisture profile indicated that the aggregate steam output of CD zone 1 should be 20% of the total possible output of CD zone 1, CD zone 2's aggregate steam output should be 80% of CD zone 2's total possible output, CD zone 3 should be 50% of CD zone 3's total possible output, and CD zone 4 should be 60% of CD zone 4's total possible output, the following valves 13 would be open:

CD zone 1: 13*a*1 and 13*b*1=20% of actual steam output for CD zone 1;

CD zone 2: 13*c*2 and 13*d*2; =80% of actual steam output for CD zone 2;

CD zone 3: 13*d*3=53⅓% of actual steam output for CD zone 3;

CD zone 4: 134, 13*a*4=60% of actual steam output for CD zone 4.

FIG. 3 is a detailed view of a valve 13 than can be used with the steam box assembly 1. The valve may be a solenoid steam valve comprising a steam valve component 14 and a solenoid component 73.

Figure 4:
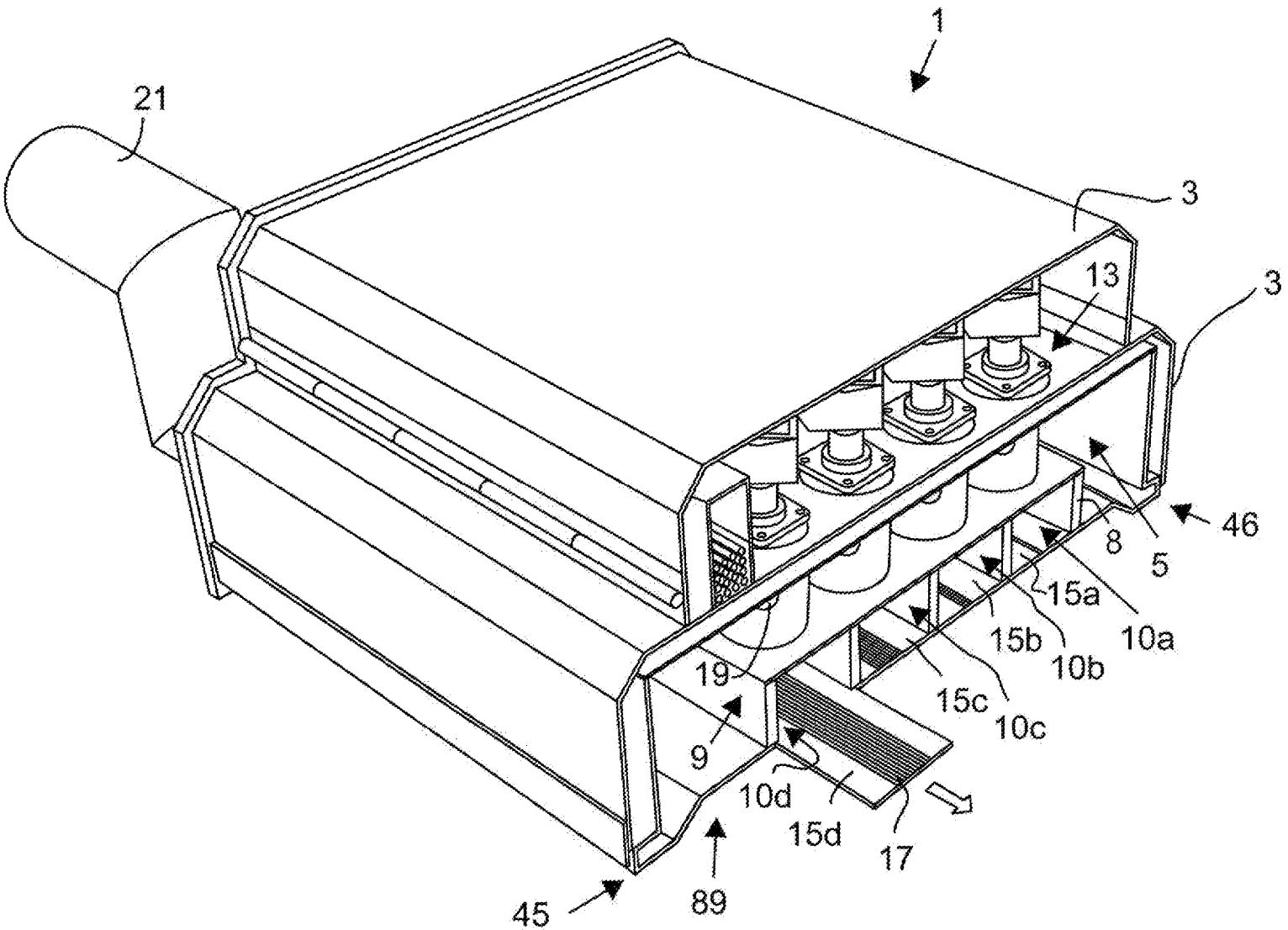
FIG. 4 is a top-down perspective view showing removable diffuser plates from the diffuser chambers.

FIG. 4 is a perspective view of an exemplary steam box 1. FIG. 4 highlights an embodiment in which the diffuser plates 15 are removable. FIG. 4 depicts the fourth diffuser plate 15*a* being slid out from under the fourth diffuser chamber 10*a*. It is contemplated that having multiple removable diffuser plates 15 may allow servicers to repair and replace worn plates while minimizing downtime. Further, removable diffuser plates 15 may allow operators to change the pattern of orifices 17 on each diffuser plate 15 to adjust for different physical characteristics of a web 20 (FIG. 1) or to accommodate changing characteristics for a running web 20. FIG. 4 also depicts a steam inlet conduit 21. This inlet conduit 21 conveys steam 7 from a steam source into the steam header 5.

Figure 7:
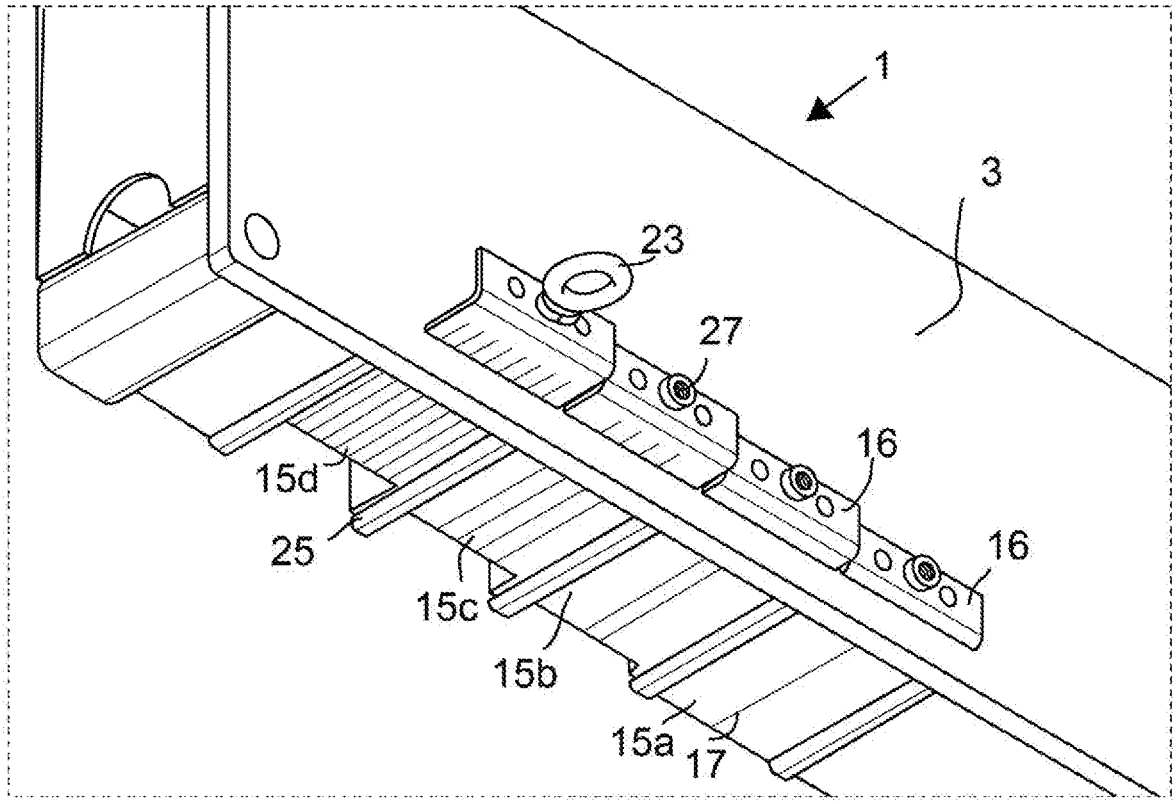
FIG. 7 is a close-up bottom-up perspective view of a portion of an exemplary steam box detailing the removeable diffuser plates.

FIG. 7 depicts further views of an exemplary steam box embodiment. It is contemplated that the use of multiple valves 13, multiple diffuser chambers 10*a*, 10*b*, 10*c*, 10*d*, etc., and multiple diffuser plates 15 can allow designers to make the overall steam box 1 more compact than conventional designs. The depicted embodiment lacks the outer steam header 66 and the angled exhaust orifices 95 shown in the convention steam box 50 in FIG. 8, thereby permitting exemplary embodiments to be smaller than conventional designs like those depicted in FIG. 8. Exemplary embodiments can forgo the outer steam header 66 and the angled exhaust orifices 95 because the exemplary embodiments can preserve optimal steam speed to optimal steam absorption into the web 20. Furthermore, preserving a constant rate of steam speed with the exemplary embodiments permits less steam "dwell time" between the exhaust side 89 and the web 20 compared to the conventional design disclosed in FIG. 8. The reduced dwell time permits exemplary steam boxes 1 to be shorter in the MD compared to designs that use outer steam headers 66 and angled exhaust orifices 95.

FIG. 7 further details a key 23 and lock 27 assembly that can be used to remove the removable diffuser plates 15. In the depicted embodiment, the diffuser plates 15 have a backside 16 extending through the steam box housing 3. The backside 16 has a lock assembly 17 configured to receive a key 23. The key 23 may be a ring, handle, lever, or other device configured to unlock the removable diffuser plate 15 and preferably to facilitate the removal of such diffuser plate 15. The diffuser plate may slide along rails 25 as the diffuser plate 15 exits the steam box housing 3. It will be understood that any way of removably securing the diffuser plate 15 to the steam box 1 is considered to be within the scope of this disclosure.

Figure 9:
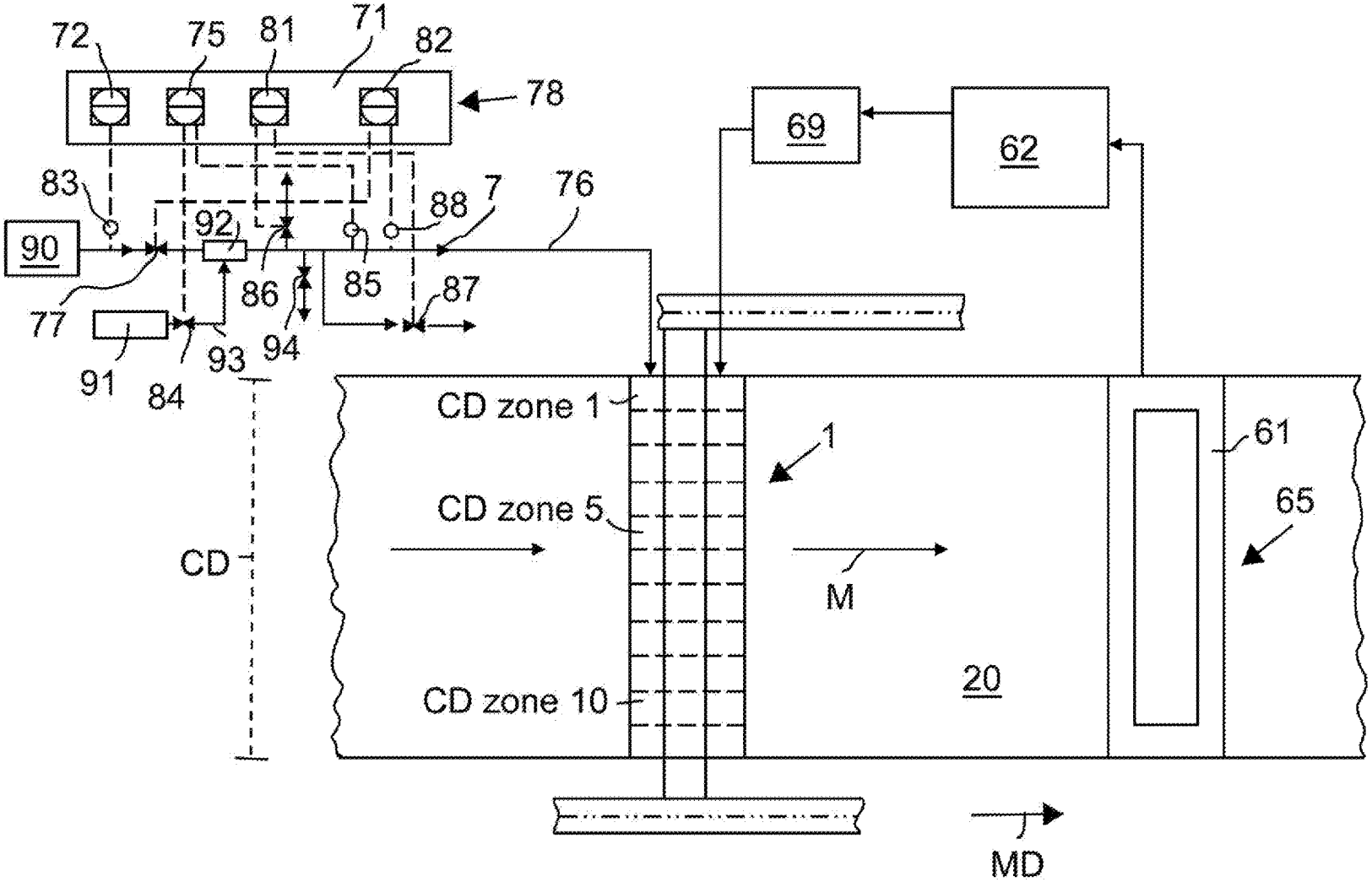
FIG. 9 is a schematic representation of an exemplary steam box system comprising a steam capacity control system.

FIG. 9 is a schematic representation of an exemplary steam box system in accordance with the present disclosure. The web 20 moves in direction M under an exemplary steam box 1 and a measurement platform 61 disposed downstream of the steam box 1. One or more sensors 65 are disposed in the measurement platform 61. The sensor 65 typically travels back and forth across the CD of the web 20 and scans the web 20 to create a high-resolution CD moisture profile every time the sensor 65 traverses the web 20. Measurement intervals may vary, but the sensor 65 commonly traverses the web 20 every 30 to 60 seconds. The sensor 65 then transmits the high-resolution CD moisture profile to CD control software 62. Although the CD control software 62 is depicted as a separate object in FIG. 9, it is understood that the CD control software may run in the measurement platform 61, the steam box controller 69, or on any other platform configured to run software.

The CD moisture profile is readable by the CD control software 62. The CD control software then maps the high-resolution CD moisture profile into a CD control profile that matches the moisture content of the web 20 a steam box CD zone. For example, the high-resolution CD moisture profile typically comprises a series of arrays of sensor data. Arrays 1-10 for example may correspond to the area of the web 20 affected by CD zone 1 of the exemplary steam box 1. Arrays 11-20 may correspond to CD zone 2, etc. The CD control software 62 then calculates a steam capacity target (expressed in a percentage of the steam box's total available flow capacity (Table 1 and Table 2)) for steam flow from the CD zones after every scanner update. If the moisture of a given CD zone is less than the average for example, the steam box setpoint will be decreased. If the moisture of a given CD zone is higher than the average, the steam flow capacity will increase.

The CD control software 62 generates an output. The output contains the setpoint data for the steam box controller 69. The output is transmitted as a signal to the steam box controller 69 to adjust the steam flow capacity. The steam box controller 69 rounds the steam capacity target to the closest binary number that will be used to control the valves 13 (Table 1 and Table 2). For example, with reference to the embodiment disclosed in FIG. 2 and to Table 1, if the CD control software sets the steam capacity target of CD zone 2 to 72% of CD zone 2's total steam output capacity, then the steam box controller 69 will round 72% to the closest step in Table 1, which is step 11. The number "11" is expressed as "1011" in binary. The binary expression "1011," when transmitted programmatically as an electrical or pneumatic signal, to the steam box 1, will open valves 13*d*2, 13*b*2, and 13*a*2 and close valve 13*c*2 to adjust the output capacity of CD zone 2 while maintaining a constant steam speed for the steam 7*c* that exits the exhaust side 89 of the steam box 1 in CD zone 2. The actual steam capacity output of CD zone 2 will be 73⅓% of CD zone 2's total output capacity.

Feedback and status signals from the steam box controller 69 can be transmitted back to the CD control software 62. It will be appreciated that signals can be transmitted via wires (e.g. Ethernet, serial communication link, or other physical connectivity) or wirelessly.

Upon receipt of the setpoint data, the steam box controller 69 converts the setpoints to electrical or pneumatic signals to control the open or closed position of the valves 13 in each CD zone. The electrical or pneumatic signals may be transmitted to the steam box 1 via one signal line per CD zone. In other exemplary embodiments, a single interface may be used with intelligent control valves 13. The steam box controller 69 can also transmit status or feedback signals to the CD control software 62 and an operator display. It will be appreciated that operator displays may be used to visualize any of the data utilized by this exemplary system. The displays may be secured proximate to system equipment, or the displays may be on portable devices.

FIG. 9 further details a steam supply system 78. The steam supply system 78 comprises a steam supply controller 71 such as a DCS or a PLC. The steam supply controller 71 controls a flow indicator 72, a temperature controller 75, interlocks 81, and a pressure controller 82. The flow indicator 72 signally communicates with a flow sensor 83. "Signally communicates" means that a signal is transmitted from one point and is received by another via wires or wirelessly. In FIG. 9, the signal communication is represented by the dotted lines between two points. The temperature controller 75 signally communicates with a temperature valve 84 and a temperature sensor 85. The interlocks 81 signally communicate with a vent valve 86 and a drain valve 87. The vent valve 86 and drain valve 87 are typically used with the start-up and shut down of the steam supply system 87. The pressure controller 82 signally communicates with the pressure control valve 77 and a pressure sensor 88.

Steam 7 from the steam source 90 travels through the steam supply line 76 past the flow sensor 83. The flow sensor 83 can measure the amount of steam 7 and the rate of steam 7 entering the steam supply system 78. Steam 7 from the steam source 90 may have a temperature of over 300 degrees Fahrenheit ("° F.") and enter the steam supply system 78 at a pressure of between about 70 pounds per inch ("ppi") to about 150 ppi. Exemplary steam boxes 1 can be rated to accommodate pressures of less than 15 ppi.

To reduce the pressure of the incoming steam 7, the pressure controller 82 open and closes the pressure control valve 77 to limit the amount of steam available to the steam box 1. Readings from the pressure sensor 88 indicate the adjustments that the pressure controller 82 should make. If the readings from the pressure sensor 88 ever indicate that the steam in the steam supply line 76 surpasses the design-rated pressure of the steam box 1, a safety valve 94 will open to vent the excess steam 7.

It is desirable to reduce the temperature of the steam 7 to be just above the boiling point of water for the steam's pressure. Being just above the boiling point permits the steam 7*c* to condense into the web 20 faster than hotter steam that is significantly above water's boiling point. The temperature sensor 85 measures the temperature of the steam 7 in the steam supply line 76 and transmits the steam's temperature at intervals to the temperature controller 75. The temperature controller 75 in turn transmits signals to the temperature valve 84, which regulates the amount of cooling water 93 that is introduced into the steam supply line 76. The cooling water 93 thereby reduces the steam's temperature to desirable levels. The cooling water 93 originates in a cooling water source 91 and mixes with the steam 7 in a desuperheater 92 disposed in the steam supply line 76.

An exemplary steam box comprises: a diffuser housing disposed within the steam header, wherein walls disposed in the diffuser housing divide an inside of the diffuser housing into multiple diffuser chambers, wherein a valve is configured to fluidly and programmatically communicate with each of the multiple diffuser chambers, such that a steam from the header box selectively enters one of the diffuser chambers depending upon the valve's orientation in an open or closed position, and multiple orifices of different sizes per diffuser chamber.

An exemplary steam box can further comprise a first diffuser plate having a steam exhaust orifice configured to permit an exit flow of steam at 1x, where "x" is the first diffuser chamber steam capacity. An exemplary steam box can further comprise a second diffuser plate configured to have an exit flow of steam at 2x, wherein "x" is the first diffuser chamber steam capacity. An exemplary steam box can further comprise a third diffuser plate configured to have an exit flow of steam at 4x, wherein "x" is the first diffuser chamber steam capacity. An exemplary steam box can further comprise fourth diffuser plate configured to have an exit flow of steam at 8x, wherein "x" is the first diffuser chamber steam capacity. In certain exemplary embodiments, the first diffuser chamber steam capacity is 1% to 6⅔% of the steam box's total steam capacity. In other exemplary embodiments, the first diffuser chamber steam capacity is 1%-3.23% of the steam box's total steam capacity.

An exemplary steam box assembly can comprise: a steam box housing; a diffuser housing disposed within the steam box housing, wherein the diffuser housing comprises a top, and walls extending downwardly from the top; wherein the top of the diffuser housing and the walls of the diffuser housing define multiple diffuser chambers disposed adjacently in a machine direction, and wherein the multiple diffuser chambers further comprise a first diffuser chamber adjacently disposed to a second diffuser chamber; a diffuser plate engaged to the steam box housing distal from the top of the diffuser housing and adjacent to the multiple diffuser chambers to define an exhaust side, the diffuser plate having orifices defining multiple steam exhaust orifice areas, wherein a first steam exhaust orifice area of the multiple steam exhaust orifice areas is disposed at the exhaust side adjacent to the first diffuser chamber, wherein a second steam exhaust orifice area of the multiple steam exhaust orifice areas is disposed at the exhaust side adjacent to the second diffuser chamber; and multiple valves, wherein each valve of the multiple valves has a valve outlet, wherein each valve of the multiple valves is configured to have an open position and a closed position, wherein a first valve outlet of a first valve of the multiple valves fluidly communicates with the first diffuser chamber, wherein a second valve outlet of at least a second valve of the multiple valves fluidly communicates with the second diffuser chamber, wherein the first steam exhaust orifice area has a first value, wherein the second steam exhaust orifice area has a second value, and wherein the second value is equal to an exponentiation $v^n$, wherein "v" is the first value, and "n" is a real number excluding 0.

A further exemplary steam box system can comprise: a steam box housing; a diffuser housing disposed within the steam box housing, wherein the diffuser housing comprises a top, and walls extending downwardly from the top, wherein the top of the diffuser housing and the walls of the diffuser housing define multiple diffuser chambers in the diffuser housing disposed adjacently in a machine direction, and wherein the multiple diffuser chambers further comprise a first diffuser chamber adjacently disposed to a second diffuser chamber; a diffuser plate engaged to the steam box housing distal from the top of the diffuser housing and adjacent to the multiple diffuser chambers to define an exhaust side, the diffuser plate having orifices defining multiple steam exhaust orifice areas, wherein a first steam exhaust orifice area of the multiple steam exhaust orifice areas is disposed at the exhaust side adjacent to the first diffuser chamber, wherein a second steam exhaust orifice area of the multiple steam exhaust orifice areas is disposed at the exhaust side adjacent to the second diffuser chamber; multiple valves, wherein each valve of the multiple valves has a valve outlet, wherein each valve of the multiple valves is configured to have an open position and a closed position, wherein a first valve outlet of a first valve of the multiple valves fluidly communicates with the first diffuser chamber, wherein a second valve outlet of at least a second valve of the multiple valves fluidly communicates with the second diffuser chamber, wherein the first steam exhaust orifice area has a first value, wherein the second steam exhaust orifice area has a second value, and wherein the second value is equal to an exponentiation $v^n$, wherein "v" is the first value, and "n" is a real number excluding 0; a sensor disposed downstream of the steam box, wherein the sensor is configured to obtain a measurement of a CD moisture profile of a fibrous web at a time interval; and a controller configured to receive the measurement and to compare the measurement to a desired CD moisture profile, wherein the controller is further configured to open or close at least one valve of the multiple valves to adjust an amount of steam output.

An exemplary method to adjust the amount of available steam exiting a steam box can comprise: (a). measuring a CD moisture profile of a fibrous web in a paper, tissue, or non-woven manufacturing line to obtain a CD moisture profile measurement; (b). comparing the CD moisture profile measurement to a desired CD moisture profile; (c.) adjusting valves of a steam box from an open position to a closed position, or from the closed position to the open position to change the amount of available steam introduced into a diffuser chamber of a steam box; and (d.) repeating steps a. through c. until the CD moisture profile measurement equals the desired CD moisture profile, wherein the valves are disposed in the steam box, wherein the steam box comprises a diffuser housing disposed within a steam box housing, the diffuser housing comprising a top, walls, and a plurality of diffuser plates, wherein the top, the walls, and a first diffuser plate of the plurality of diffuser plates define a first diffuser chamber in the diffuser housing, wherein the top, the walls, and a second diffuser plate of the plurality of diffuser plates define a second diffuser chamber in the diffuser housing, wherein a first valve outlet of at least a first valve of the valves fluidly communicates with the first diffuser chamber, wherein at a second valve outlet of at least a second valve of the valves fluidly communicates with the second diffuser chamber, wherein the first diffuser plate defines a first steam exhaust orifice area having a first value, wherein the second diffuser plate defines a second steam exhaust orifice area, and wherein the second steam exhaust orifice area has a second value, the second value being equal to an exponentiation $v^n$, wherein "v" is the first value, and "n" is a real number excluding 0.

An exemplary steam box assembly can further comprise a first diffuser plate having a steam exhaust orifice configured to permit an exit flow of steam at 1x, where "x" is a first diffuser chamber steam capacity.

An exemplary steam box assembly can further comprise a second diffuser plate configured to have an exit flow of steam at 2x, wherein "x" is the first diffuser chamber steam capacity.

An exemplary steam box assembly can further comprise a third diffuser plate configured to have an exit flow of steam at 4x, wherein "x" is the first diffuser chamber steam capacity.

An exemplary steam box assembly can further comprise fourth diffuser plate configured to have an exit flow of steam at 8x, wherein "x" is the first diffuser chamber steam capacity.

The first diffuser chamber can have a steam capacity that is about 6⅔% of the steam box's total steam capacity in an exemplary embodiment. In certain exemplary embodiments, the first diffuser chamber steam capacity is about 3.23% of the steam box's total steam capacity.

An exemplary steam box assembly can comprise: a steam box housing; a diffuser housing disposed within the steam box housing, wherein the diffuser housing comprises a top, and walls; a diffuser plate slidably engaged to a bottom of the steam box housing, wherein the top of the diffuser housing and the walls of the diffuser housing define multiple diffuser chambers, and a first diffuser plate of the plurality of diffuser plates define a first diffuser chamber in the diffuser housing, wherein the top of the diffuser housing, the walls of the diffuser housing, and a second diffuser plate of the plurality of diffuser plates define a second diffuser chamber in the diffuser housing; and multiple valves, wherein each valve of the multiple valves has a valve outlet, wherein each valve of the multiple valves is configured to have an open position and a closed position, wherein a first valve outlet of at least a first valve of the multiple valves fluidly communicates with the first diffuser chamber, wherein at a second valve outlet of at least a second valve of the multiple valves fluidly communicates with the second diffuser chamber, wherein the first diffuser plate defines a first steam exhaust orifice area having a first value, wherein the second diffuser plate defines a second steam exhaust orifice area, and wherein the second steam exhaust orifice area has a second value.

In certain exemplary embodiments, the top of the diffuser housing, the walls of the diffuser housing, and a third diffuser plate of the plurality of diffuser plates further define a third diffuser chamber in the diffuser housing, and wherein the third diffuser plate defines a third steam exhaust orifice area, and wherein the third steam exhaust orifice area has a third value, the third value being equal to a second exponentiation $v^n$, wherein "v" is the first value, and "n" is a real number excluding 0.

In certain exemplary embodiments, the top of the diffuser housing, the walls of the diffuser housing, and a fourth diffuser plate of the plurality of diffuser plates define a fourth diffuser chamber in the diffuser housing, and wherein the fourth diffuser plate defines a fourth steam exhaust orifice area, and wherein the fourth steam exhaust orifice area has a fourth value, the fourth value being equal to a third exponentiation $v^n$, wherein "v" is the first value, and "n" is a real number excluding 0.

In certain exemplary embodiments, wherein $v^n$ is a power of 2, the second value is twice the first value, the third value is four times the first value, and the fourth value is eight times the first value.

In certain exemplary embodiments, the top of the diffuser housing, the walls of the diffuser housing, and a fifth diffuser plate of the plurality of diffuser plates define a fifth diffuser chamber in the diffuser housing, and wherein the fifth diffuser plate defines a fifth steam exhaust orifice area, and wherein the fifth steam exhaust orifice area has a fifth value, the fifth value being equal to a fourth exponentiation $v^n$, wherein "v" is the first value, and "n" is a real number excluding 0.

In certain exemplary embodiments, the second value being equal to an exponentiation $v^n$, wherein "v" is the first value, and "n" is a real number excluding 0.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the invention.

What is claimed is:

1. A steam box assembly comprising:

a steam box housing;

a diffuser housing disposed within the steam box housing;

wherein the diffuser housing comprises a top, and walls extending downwardly from the diffuser housing top;

wherein the top of the diffuser housing and the walls of the diffuser housing define multiple diffuser chambers disposed adjacently in a machine direction of a papermaking machine, and wherein the multiple diffuser chambers further comprise a first diffuser chamber adjacently disposed to a second diffuser chamber;

a diffuser plate engaged to the steam box housing distal from the top of the diffuser housing and adjacent to the multiple diffuser chambers to define an exhaust side for each of the multiple diffuser chambers, the diffuser plate having steam orifices defining multiple steam exhaust orifice areas configured to exhaust steam from the multiple diffuser chambers at a constant exit steam speed, wherein each steam orifice in the multiple steam exhaust orifice areas is a same size, wherein a first steam exhaust orifice area of the multiple steam exhaust orifice areas is disposed at the exhaust side adjacent to the first diffuser chamber, wherein a second steam exhaust orifice area of the multiple steam exhaust orifice areas is disposed at the exhaust side adjacent to the second diffuser chamber; and multiple valves, wherein each valve of the multiple valves has a valve outlet, wherein each valve of the multiple valves is configured to have an open position and a closed position, wherein a first valve outlet of a first valve of the multiple valves fluidly communicates with the first diffuser chamber, wherein a second valve outlet of a second valve of the multiple valves fluidly communicates with the second diffuser chamber, wherein the first steam exhaust orifice area includes a first number of steam orifices such that the first steam exhaust orifice area is equal to a first integer value greater than zero, and wherein the second steam exhaust orifice area includes a second number of steam orifices such that the second steam exhaust orifice area is equal to a second integer value "$v^{n}$", wherein "v" is an integer value greater than the first integer value, and an exponent "n" is a real number excluding zero.

2. The steam box of claim 1, wherein "v" is equal to 2.

3. The steam box of claim 1, wherein "v" is equal to 3.

4. The steam box of claim 1, wherein "v" is equal to other than 0, 1, 2 or 3.

5. A steam box system comprising:

a steam box housing;

a diffuser housing disposed within the steam box housing, wherein the diffuser housing comprises a top, and walls extending downwardly from the top, wherein the top of the diffuser housing and the walls of the diffuser housing define multiple diffuser chambers in the diffuser housing disposed adjacently in a machine direction of a papermaking machine, and wherein the multiple diffuser chambers further comprise a first diffuser chamber adjacently disposed to a second diffuser chamber;

a diffuser plate engaged to the steam box housing distal from the top of the diffuser housing and adjacent to the multiple diffuser chambers to define an exhaust side for each of the multiple diffuser chambers, the diffuser plate having steam orifices defining multiple steam exhaust orifice areas configured to exhaust steam from the multiple diffuser chambers at a constant exit steam speed, wherein each steam orifice in the multiple steam exhaust orifice areas is a same size, wherein a first steam exhaust orifice area of the multiple steam exhaust orifice areas is disposed at the exhaust side adjacent to the first diffuser chamber, wherein a second steam exhaust orifice area of the multiple steam exhaust orifice areas is disposed at the exhaust side adjacent to the second diffuser chamber;

multiple valves, wherein each valve of the multiple valves has a valve outlet, wherein each valve of the multiple valves is configured to have an open position and a closed position, wherein a valve outlet of a first valve of the multiple valves fluidly communicates with the first diffuser chamber, wherein a valve outlet of at least a second valve of the multiple valves fluidly communicates with the second diffuser chamber, wherein the first steam exhaust orifice area includes a number of steam orifices such that the first steam exhaust orifice area is equal to a first integer value, and wherein the second steam exhaust orifice area includes a number of steam orifices such that the second steam exhaust orifice area is equal to a second integer value "$v^{n}$", wherein "v" is an integer value greater than the first integer value, and an exponent "n" is a real number excluding zero;

a sensor disposed downstream of the steam box, wherein the sensor is configured to obtain a measurement of a CD moisture profile of a fibrous web at a time interval; and a controller configured to receive the measurement and to compare the measurement to a desired CD moisture profile, wherein the controller is further configured to open or close at least one valve of the multiple valves to adjust an amount of steam output.

6. A method to adjust an amount of available steam exiting a steam box, the method comprising:

a. measuring a CD moisture profile of a fibrous web in a paper, tissue, or non-woven manufacturing line to obtain a CD moisture profile measurement;

b. comparing the CD moisture profile measurement to a desired CD moisture profile;

c. adjusting valves of a steam box from an open position to a closed position, or from the closed position to the open position to change the amount of available steam introduced into a diffuser chamber of a steam box; and d. repeating steps a. through c. until the CD moisture profile measurement equals the desired CD moisture profile, wherein the valves are disposed in the steam box, wherein the steam box comprises a diffuser housing disposed within a steam box housing, the diffuser housing comprising a top, walls, and a plurality of diffuser plates, wherein the top, the walls, and a first diffuser plate of the plurality of diffuser plates define a first diffuser chamber in the diffuser housing, wherein the top, the walls, and a second diffuser plate of the plurality of diffuser plates define a second diffuser chamber in the diffuser housing, wherein a first valve outlet of at least a first valve of the valves fluidly communicates with the first diffuser chamber, wherein a second valve outlet of at least a second valve of the valves fluidly communicates with the second diffuser chamber, wherein the first diffuser plate defines a first steam exhaust orifice area having a first number of steam orifices such that the first steam exhaust orifice area is equal to a first integer value, and wherein the second diffuser plate defines a second steam exhaust orifice area having a second number of steam orifices such that the second steam exhaust orifice area is equal to a second integer value "$v^{n}$", wherein "v" is an integer value greater than the first integer value, and an exponent "n" is a real number excluding zero, wherein each steam orifice in each of the steam exhaust orifice areas is a same size, and wherein each of the steam exhaust orifice areas is configured to exhaust steam from the first and second diffuser chambers at a constant exit steam speed.

7. The method of claim 6 wherein the first steam exhaust orifice area of the first diffuser plate is configured to permit an exit flow of steam at 1x, where "x" is a first diffuser chamber steam capacity.

8. The method of claim 6 wherein the second steam exhaust orifice area of the second diffuser plate is configured to have an exit flow of steam at 2x, wherein "x" is a steam capacity of the first diffuser chamber.

9. The method of claim 6 wherein the steam box further comprises a third diffuser plate having a third exhaust orifice area configured to have an exit flow of steam at 4x, wherein "x" is a steam capacity of the first diffuser chamber.

10. The method of claim 6 wherein the steam box further comprises a fourth diffuser plate having a fourth exhaust orifice area configured to have an exit flow of steam at 8x, wherein "x" is a steam capacity of the first diffuser chamber.

11. The method of claim 6, wherein a steam capacity of the first diffuser chamber is about 6⅔% of a total steam capacity of the steam box.

12. The method of claim 6, wherein a steam capacity of the first diffuser chamber is about 3.23% of a total steam capacity of the steam box.

13. A steam box assembly comprising:

a steam box housing;

a diffuser housing disposed within the steam box housing, wherein the diffuser housing comprises a top, and walls;

a plurality of diffuser plates slidably engaged to a bottom of the steam box housing, wherein the top of the diffuser housing, the plurality of diffuser plates, and the walls of the diffuser housing define multiple diffuser chambers disposed adjacently in a machine direction of a papermaking machine, and a first diffuser plate of the plurality of diffuser plates defines a first diffuser chamber of the multiple diffuser chambers in the diffuser housing, wherein the top of the diffuser housing, the walls of the diffuser housing, and a second diffuser plate of the plurality of diffuser plates define a second diffuser chamber in the diffuser housing; and multiple valves, wherein each valve of the multiple valves has a valve outlet, wherein each valve of the multiple valves is configured to have an open position and a closed position, wherein a first valve outlet of a first valve of the multiple valves fluidly communicates with the first diffuser chamber, wherein at a second valve outlet of a second valve of the multiple valves fluidly communicates with the second diffuser chamber, wherein the first diffuser plate defines a first steam exhaust orifice area having a first number of steam orifices such that the first steam exhaust orifice area is equal to a first integer value greater than zero, wherein the second diffuser plate defines a second steam exhaust orifice area having a second number of steam orifices such that the second steam exhaust orifice area is equal to a second integer value "v" raised to an exponent "n", wherein "v" is an integer value greater than the first integer value and the exponent "n" is a real number excluding zero such that "$v^{n}$" is an integer value, wherein each steam orifice in each of the steam exhaust orifice areas is a same size, and wherein each of the steam exhaust orifice areas is configured to exhaust steam from the multiple diffuser chambers at a constant exit steam speed.

14. The steam box assembly of claim 13, wherein the top of the diffuser housing, the walls of the diffuser housing, and a third diffuser plate of the plurality of diffuser plates further define a third diffuser chamber in the diffuser housing, and wherein the third diffuser plate defines a third steam exhaust orifice area having a number of steam orifices equal to a third integer value being equal to the second integer value "v" raised to an exponent "n", wherein the exponent "n" for the third integer value is a real number greater than the exponent "n" for the second integer value such that the third integer value is greater than the second integer value.

15. The steam box of claim 14, wherein the top of the diffuser housing, the walls of the diffuser housing, and a fourth diffuser plate of the plurality of diffuser plates define a fourth diffuser chamber in the diffuser housing, and wherein the fourth diffuser plate defines a fourth steam exhaust orifice area having a number of steam orifices equal to a fourth integer value, the fourth integer value being equal to the second integer value "v" raised to an exponent "n", wherein the exponent "n" for the fourth integer value is a real number greater than the exponent "n" for the third integer value such that the fourth integer value is greater than the third integer value.

16. The steam box assembly of claim 15, wherein the second integer value is a power of 2, the third integer value is twice the second integer value, and the fourth integer value is four times the second integer value.

17. The steam box assembly of claim 13, wherein the top of the diffuser housing, the walls of the diffuser housing, and a fifth diffuser plate of the plurality of diffuser plates define a fifth diffuser chamber in the diffuser housing, and wherein the fifth diffuser plate defines a fifth steam exhaust orifice area, having a number of steam orifices equal to a fifth integer value being equal to the second integer value "v" raised to an exponent "n", wherein the exponent "n" for the fifth integer value is a real number greater than the exponent "n" for the fourth integer value such that the fifth integer value is greater than the fourth integer value.

* * * * *